US012078427B2

(12) United States Patent
Yamada et al.

(10) Patent No.: US 12,078,427 B2
(45) Date of Patent: Sep. 3, 2024

(54) HEAT EXCHANGER AND AIR CONDITIONER HAVING THE SAME

(71) Applicant: DAIKIN INDUSTRIES, LTD., Osaka (JP)

(72) Inventors: Kouju Yamada, Osaka (JP); Ken Satou, Osaka (JP); Masanori Jindou, Osaka (JP); Yoshio Oritani, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 18/216,177

(22) Filed: Jun. 29, 2023

(65) Prior Publication Data

US 2023/0341189 A1 Oct. 26, 2023

Related U.S. Application Data

(63) Continuation of application No. 16/757,208, filed as application No. PCT/JP2018/037759 on Oct. 10, 2018, now Pat. No. 11,732,971.

(30) Foreign Application Priority Data

Oct. 18, 2017 (JP) ..... 2017-201545

(51) Int. Cl.
*F28F 9/02* (2006.01)
*F28D 7/16* (2006.01)

(52) U.S. Cl.
CPC ..... *F28D 7/1653* (2013.01); *F28F 9/0224* (2013.01); *F28F 2225/08* (2013.01)

(58) Field of Classification Search
CPC ..... F28F 9/02; F28F 9/0204; F28F 9/0207; F28F 9/0243; F28F 9/0224; F28F 2225/08
See application file for complete search history.

(56) References Cited

U.S. PATENT DOCUMENTS

2004/0226705 A1 11/2004 Hiyama et al.
2017/0276411 A1 9/2017 Taras et al.
(Continued)

FOREIGN PATENT DOCUMENTS

CN 106716045 A 5/2017
DE 19524052 A1 1/1997
(Continued)

OTHER PUBLICATIONS

International Search Report issued in International Application No. PCT/JP2018/037759, mailed on Dec. 25, 2018 (3 pages).
(Continued)

*Primary Examiner* — Eric S Ruppert
(74) *Attorney, Agent, or Firm* — Osha Bergman Watanabe & Burton LLP

(57) ABSTRACT

A heat exchanger includes: flat pipes each including a passage for refrigerant that are arranged side by side in a predetermined step direction; and a header collecting pipe extending along the predetermined step direction that is connected to the flat pipes. The header collecting pipe includes: a flat pipe-side header forming member; and an opposite-side header forming member facing the flat pipe-side header forming member. The flat pipes are inserted in the flat pipe-side header forming member and an internal space exists between the flat pipe-side header forming member and the opposite-side header forming member. When viewed along the predetermined step direction: the flat pipe-side header forming member has a flat pipe-side curved portion protruding toward the flat pipes and the opposite-side header forming member has an opposite-side curved portion protruding toward a side away from the flat pipes.

4 Claims, 17 Drawing Sheets

(56) References Cited

U.S. PATENT DOCUMENTS

| | | | |
|---|---|---|---|
| 2017/0292741 | A1 | 10/2017 | Inoue et al. |
| 2018/0195815 | A1 | 7/2018 | Takase |

FOREIGN PATENT DOCUMENTS

| | | | | |
|---|---|---|---|---|
| DE | 112014003913 | T5 | | 5/2016 |
| EP | 3203175 | A1 | | 8/2017 |
| FR | 2887975 | A1 | | 1/2007 |
| JP | H05-157485 | A | | 6/1993 |
| JP | 2005-037037 | A | | 2/2005 |
| JP | 2009250518 | A | | 10/2009 |
| JP | 2016-125748 | A | | 7/2016 |
| KR | 20060076843 | A | * | 7/2006 |
| KR | 20100025194 | A | | 3/2010 |
| KR | 20110002555 | A | | 1/2011 |
| WO | 2017/018540 | A1 | | 2/2017 |

OTHER PUBLICATIONS

International Preliminary Report on Patentability issued in corresponding International Patent Application No. PCT/ JP2018/037759, mailed on Apr. 30, 2020 (8 pages).

Extended European Search Report issued in corresponding European Patent Application No. 18869213.1, dated May 25, 2021 (6 pages).

Extended European search report issued in corresponding European Application No. 23170649.0 dated Jun. 12, 2023 (9 pages).

* cited by examiner

HEAT EXCHANGER AND AIR CONDITIONER HAVING THE SAME

CROSS-REFERENCE TO RELATED APPLICATIONS

This is a continuation application of U.S. patent application Ser. No. 16/757,208, filed Apr. 17, 2020, which is a national stage application of International Patent Application No. PCT/JP2018/037759, filed Oct. 9, 2018, which claims priority to Japanese Patent Application No. 2017-201545, filed Oct. 18, 2017. The contents of these priority applications are incorporated herein by reference.

TECHNICAL FIELD

The present disclosure relates to a heat exchanger and an air conditioner having the same, and more particularly, to a heat exchanger including flat pipes and a header collecting pipe connected with the flat pipes, and an air conditioner having the same.

BACKGROUND

Conventionally, as a heat exchanger used in an air conditioner, a heat exchanger having flat pipes and a header collecting pipe to which the flat pipes are connected may be employed. A plurality of flat pipes are arranged side by side in a predetermined step direction, and the header collecting pipe extends along the step direction. As a header collecting pipe constituting such a heat exchanger, for example, as shown in Patent Literature 1 (JP 2016-125748 A), a structure including a flat pipe-side header forming member to which a flat pipe is inserted, and an opposite-side header forming member facing the flat pipe-side header forming member and forming an internal space between the opposite-side header forming member and the flat pipe-side header forming member, may be adopted. Here, the flat pipe-side header forming member has a flat pipe-side curved portion protruding toward the flat pipe side when viewed along the step direction. The opposite-side header forming member has an opposite-side curved portion protruding toward the side away from the flat pipe when viewed along the step direction.

Recently, a reduction in the amount of refrigerant possessed by the air conditioner (refrigerant saving) has been demanded. In order to meet such a demand for refrigerant saving, the volume of the heat exchanger is reduced. However, while Patent Literature 1 describes a heat exchanger having flat pipes and a header collecting pipe to which the flat pipes are connected as described above, and an air conditioner having the same, there is no description on reduction of the volume of the heat exchanger and on refrigerant saving.

PATENT LITERATURE

Patent Literature 1: JP 2016-125748 A

SUMMARY

One or more embodiments of the present invention reduce the volume of a heat exchanger and realize refrigerant saving, in a heat exchanger having flat pipes and a header collecting pipe to which the flat pipes are connected and an air conditioner having the heat exchanger.

A heat exchanger according to one or more embodiments includes a plurality of flat pipes arranged side by side in a predetermined step direction and having a refrigerant passage formed therein, and a header collecting pipe connected with the flat pipes and extending along the step direction. The header collecting pipe includes a flat pipe-side header forming member to which the flat pipes are inserted, and an opposite-side header forming member that faces the flat pipe-side header forming member and forms an internal space between the opposite-side header forming member and the flat pipe-side header forming member. The flat pipe-side header forming member includes a flat pipe-side curved portion protruding toward the flat pipe side when viewed along the step direction. The opposite-side header forming member has an opposite-side curved portion protruding toward a side away from the flat pipes when viewed along the step direction. Here, the inner diameter of the opposite-side curved portion is smaller than the inner diameter of the flat pipe-side curved portion.

Here, the volume of the internal space of the header collecting pipe can be reduced corresponding to the fact that the inner diameter of the opposite-side curved portion is smaller than the inner diameter of the flat pipe-side curved portion. Thereby, the volume of the heat exchanger can be reduced.

Further, in this heat exchanger, the inner diameter of the flat pipe-side curved portion is larger than the width of the flat pipe, and the inner diameter of the opposite-side curved portion is smaller than the width of the flat pipe.

Here, the inner diameter of the opposite-side curved portion can be significantly smaller than the inner diameter of the flat pipe-side curved portion. Thereby, the volume of the internal space of the header collecting pipe can be significantly reduced.

Further, in this heat exchanger, the opposite-side header forming member further includes an opposite-side straight portion that extends straight from an end of the opposite-side curved portion when viewed along the step direction. The opposite-side straight portion is joined to the flat pipe-side header forming member.

Here, the pressure resistance of the opposite-side straight portion joined to the flat pipe-side header forming member can be increased. Thereby the pressure resistance of the header collecting pipe can be ensured.

Furthermore, in this heat exchanger, the opposite-side straight portion does not face the internal space.

Here, the opposite-side straight portion does not directly receive the internal pressure, which can contribute to securing of the pressure resistance of the header collecting pipe.

Further, in this heat exchanger, the header collecting pipe further includes an intermediate-side header forming member interposed between the flat pipe-side header forming member and the opposite-side header forming member.

Here, the flat pipe-side header forming member and the opposite-side header forming member can be joined via the intermediate-side header forming member.

Furthermore, in this heat exchanger, the intermediate-side header forming member partitions the internal space into a flat pipe-side space on the flat pipe-side header forming member side and an opposite-side space on the opposite-side header forming member side. The header collecting pipe has a loop structure in which the refrigerant flows back and forth between the flat pipe-side space and the opposite-side space.

Here, when the heat exchanger is used as a refrigerant evaporator, it is possible to suppress an uneven flow when the refrigerant is diverted from the header collecting pipe to the flat pipe.

Furthermore, in this heat exchanger, the inner diameter of the opposite-side curved portion is 0.5 to 0.75 times the inner diameter of the flat pipe-side curved portion.

Here, by setting the inner diameter of the opposite-side curved portion to be 0.5 to 0.75 times the inner diameter of the flat pipe-side curved portion, it is possible to maintain a favorable flow of the refrigerant turning back between the flat pipe-side space and the opposite-side space.

Further, in this heat exchanger, the opposite-side header forming member further includes an opposite-side straight portion that extends straight from an end of the opposite-side curved portion when viewed along the step direction. The opposite-side straight portion is joined to the intermediate-side header forming member.

Here, the pressure resistance of the opposite-side straight portion joined to the intermediate-side header forming member can be increased. Thereby, the pressure resistance of the header collecting pipe can be ensured.

Furthermore, in this heat exchanger, the opposite-side straight portion does not face the internal space.

Here, the opposite-side straight portion does not directly receive the internal pressure, which can contribute to securing of the pressure resistance of the header collecting pipe.

Moreover, in this heat exchanger, the intermediate-side header forming member has an intermediate-side straight portion that extends straight along the opposite-side straight portion when viewed along the step direction. The length of the intermediate-side straight portion is equal to or longer than the length of the opposite-side straight portion.

Here, the pressure resistance of the opposite-side straight portion can be further increased.

In this heat exchanger, the thickness of the opposite-side header forming member is smaller than the thickness of (the opposite-side header forming is thinner than) the flat pipe-side header forming member.

Here, the material cost of the opposite-side header forming member can be reduced, and thus the cost of the header collecting pipe, and eventually the heat exchanger, can be reduced.

Further, an air conditioner according to one or more embodiments includes the above-discussed heat exchanger.

Here, since the capacity of the heat exchanger can be reduced, the refrigerant can be saved.

DETAILED DESCRIPTION

Hereinafter, embodiments of a heat exchanger and an air conditioner having the same and modifications thereof, will be described with reference to the drawings. The specific configurations of the heat exchanger and the air conditioner having the same are not limited to the following embodiments and modifications thereof, and can be changed without departing from the gist of the disclosure.

(1) Configuration of Air Conditioner

Figure 1:
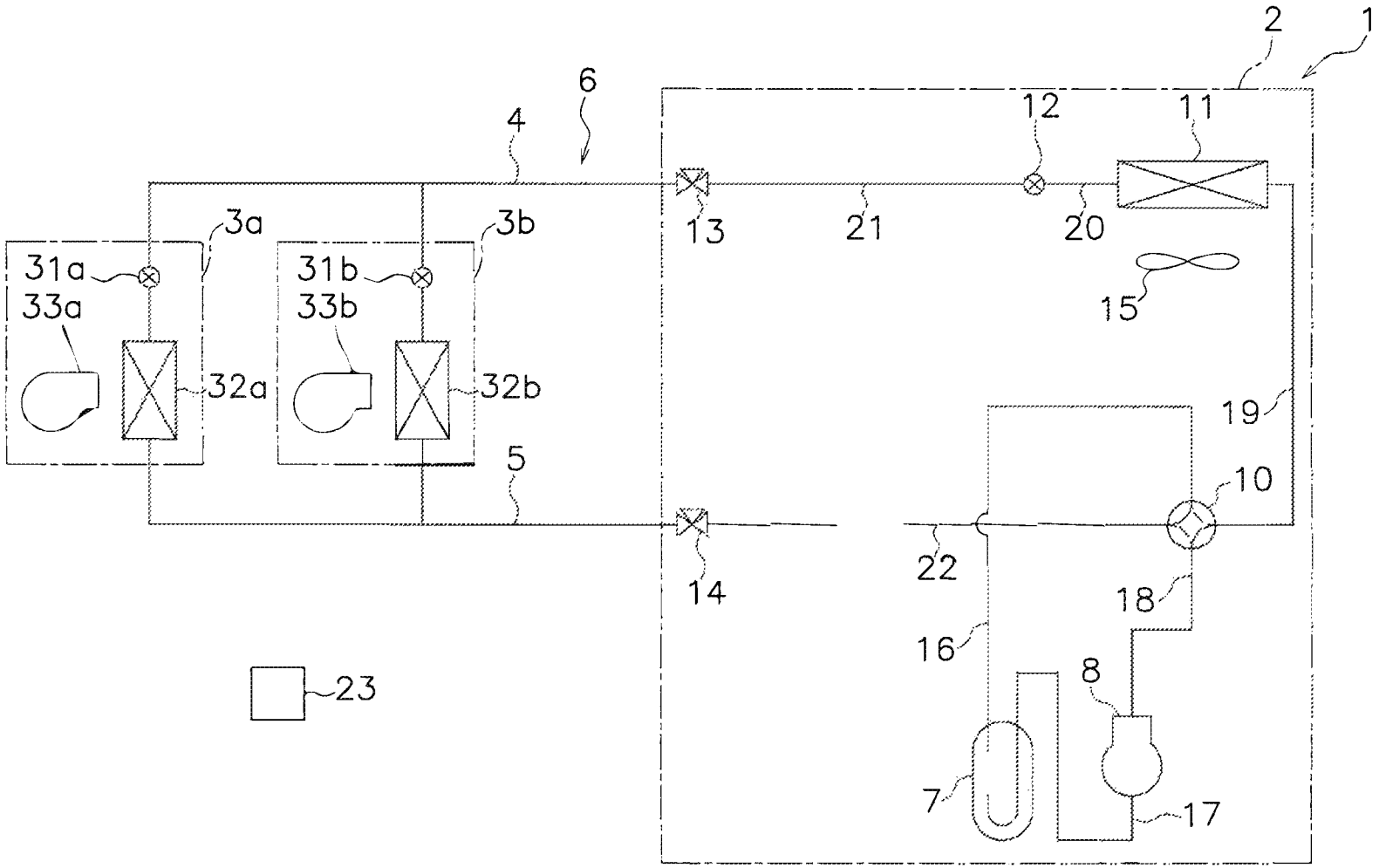
FIG. 1 is a schematic configuration diagram of an outdoor heat exchanger as a heat exchanger according to one or more embodiments of the present invention and an air conditioner including the same.

FIG. 1 is a schematic configuration diagram of an outdoor heat exchanger 11 as a heat exchanger according to one or more embodiments of the present invention and an air conditioner 1 having the same.

The air conditioner 1 is a device capable of performing cooling and heating of a room such as a building by performing a vapor compression refrigeration cycle. The air-conditioner 1 mainly includes an outdoor unit 2, indoor units 3*a* and 3*b*, a liquid-refrigerant connection pipe 4 and a gas-refrigerant connection pipe 5 connecting the outdoor unit 2 and the indoor units 3*a* and 3*b*, and a control unit 23 that controls the components of the outdoor unit 2 and the indoor units 3*a* and 3*b*. The vapor compression refrigerant circuit 6 of the air conditioner 1 is configured by connecting the outdoor unit 2 and the indoor units 3*a* and 3*b* via the connection pipes 4 and 5. In the refrigerant circuit 6, HFC refrigerant (for example, R32 or R410A), carbon dioxide, or the like is sealed as a refrigerant.

The outdoor unit 2 is installed outdoors (such as on the roof of a building or near a wall surface of a building), and forms a part of the refrigerant circuit 6. The outdoor unit 2 mainly includes an accumulator 7, a compressor 8, a four-way switching valve 10, an outdoor heat exchanger 11, an outdoor expansion valve 12 as an expansion mechanism, a liquid-side shutoff valve 13, a gas-side shutoff valve 14, and an outdoor fan 15. Respective devices and valves are connected by refrigerant pipes 16 to 22.

The indoor units 3*a* and 3*b* are installed indoors (in a living room, a space above a ceiling, or the like) and constitute a part of the refrigerant circuit 6. The indoor unit 3*a* mainly has an indoor expansion valve 31*a*, an indoor heat exchanger 32*a*, and an indoor fan 33*a*. The indoor unit 3*b* mainly includes an indoor expansion valve 31*b* as an expansion mechanism, an indoor heat exchanger 32*b*, and an indoor fan 33*b*.

The refrigerant connection pipes 4 and 5 are refrigerant pipes that are constructed locally when the air-conditioning apparatus 1 is installed at an installation location such as a building. One end of the liquid-refrigerant connection pipe 4 is connected to the liquid-side shutoff valve 13 of the indoor unit 2, and the other end of the liquid-refrigerant connection pipe 4 is connected to the liquid side ends of the indoor expansion valves 31*a* and 31*b* of the indoor units 3*a* and 3*b*. One end of the gas-refrigerant connection pipe 5 is connected to the gas-side shutoff valve 14 of the indoor unit 2, and the other end of the gas-refrigerant connection pipe is connected to the gas side ends of the indoor heat exchangers 32*a* and 32*b* of the indoor units 3*a* and 3*b*.

The control unit 23 is configured such that control boards and the like (not shown) provided in the outdoor unit 2 and the indoor units 3*a* and 3*b* are connected by communication. Note that, in FIG. 1, for convenience, the control unit 23 is illustrated at a position separated from the outdoor unit 2 and the indoor units 3*a* and 3*b*. The control unit 23 controls the components 8, 10, 12, 15, 31*a*, 31*b*, 33*a*, and 33*b* of the air conditioner 1 (here, the outdoor unit 2 and the indoor units 3*a* and 3*b*), that is, controls the entire operation of the air conditioner 1.

(2) Operation of Air Conditioner

Next, operation of the air conditioner 1 will be described using FIG. 1. In the air conditioner 1, cooling operation in which refrigerant is circulated in the order of the compressor 8, the outdoor heat exchanger 11, the outdoor expansion valve 12, the indoor expansion valves 31*a* and 31*b*, and the indoor heat exchangers 32*a* and 32*b*, and heating operation in which refrigerant is circulated in the order of the compressor 8, the indoor heat exchangers 32*a* and 32*b*, the indoor expansion valves 31*a* and 31*b*, the outdoor expansion valve 12, and the outdoor heat exchanger 11, are performed. Note that the cooling operation and the heating operation are performed by the control unit 23.

During the cooling operation, the four-way switching valve 10 is switched to the outdoor heat radiation state (the state indicated by the solid line in FIG. 1). In the refrigerant circuit 6, the low-pressure gas refrigerant of the refrigeration cycle is taken into the compressor 8, and is discharged after being compressed to the high pressure of the refrigeration cycle. The high-pressure gas refrigerant discharged from the compressor 8 is sent to the outdoor heat exchanger 11 through the four-way switching valve 10. The high-pressure gas refrigerant sent to the outdoor heat exchanger 11 radiates heat by performing heat exchange with the outdoor air supplied as a cooling source by the outdoor fan 15 in the outdoor heat exchanger 11 functioning as a radiator of the refrigerant, and becomes high-pressure liquid refrigerant. The high-pressure liquid refrigerant radiated in the outdoor heat exchanger 11 is sent to the indoor expansion valves 31*a* and 31*b* through the outdoor expansion valve 12, the liquid-side shutoff valve 13, and the liquid-refrigerant connection pipe 4. The refrigerant sent to the indoor expansion valves 31*a* and 31*b* is decompressed to the low pressure of the refrigeration cycle by the indoor expansion valves 31*a* and 31*b*, and becomes refrigerant in the low-pressure gas-liquid two-phase state. The refrigerant in the low-pressure gas-liquid two-phase state, decompressed by the indoor expansion valves 31*a* and 31*b*, is sent to the indoor heat exchangers 32*a* and 32*b*. The refrigerant in the low-pressure gas-liquid two-phase state, sent to the indoor heat exchangers 32*a* and 32*b*, exchanges heat with the indoor air supplied as a heating source by the indoor fans 33*a* and 33*b* and evaporates, in the indoor heat exchangers 32*a* and 32*b*. Thereby, the room air is cooled, and thereafter, the room air is supplied to the room, thereby cooling the room. The low-pressure gas refrigerant evaporated in the indoor heat exchangers 32*a* and 32*b* is taken into the compressor 8 again through the gas-refrigerant connection pipe 5, the gas-side shutoff valve 14, the four-way switching valve 10, and the accumulator 7.

During the heating operation, the four-way switching valve 10 is switched to the outdoor evaporation state (the state shown by the broken line in FIG. 1). In the refrigerant circuit 6, the low-pressure gas refrigerant of the refrigeration cycle is taken into the compressor 8, and is discharged after being compressed to the high pressure of the refrigeration cycle. The high-pressure gas refrigerant discharged from the compressor 8 is sent to the indoor heat exchangers 32*a* and 32*b* through the four-way switching valve 10, the gas-side shutoff valve 14, and the gas-refrigerant connection pipe 5. The high-pressure gas refrigerant sent to the indoor heat exchangers 32*a* and 32*b* performs heat exchange with the indoor air supplied as a cooling source by the indoor fans 33*a* and 33*b* and radiates heat in the indoor heat exchangers 32*a* and 32*b*, and becomes high-pressure liquid refrigerant. Thereby, the room air is heated, and thereafter, the room air is supplied to the room to heat the room. The high-pressure liquid refrigerant radiated by the indoor heat exchangers 32*a* and 32*b* is sent to the outdoor expansion valve 12 through the indoor expansion valves 31*a* and 31*b*, the liquid-refrigerant connection pipe 4, and the liquid-side shutoff valve 13. The refrigerant sent to the outdoor expansion valve 12 is decompressed to the low pressure of the refrigeration cycle by the outdoor expansion valve 12, and becomes low-pressure refrigerant in a gas-liquid two-phase state. The refrigerant in the low-pressure gas-liquid two-phase state, decompressed by the outdoor expansion valve 12, is sent to the outdoor heat exchanger 11. The refrigerant in the low-pressure gas-liquid two-phase state, sent to the outdoor heat exchanger 11, exchanges heat with outdoor air supplied as a heating source by the outdoor fan 15 and evaporates in the outdoor heat exchanger 11 functioning as a refrigerant evaporator, and becomes low pressure gas refrigerant. The low-pressure refrigerant evaporated in the outdoor heat exchanger 11 is taken into the compressor 8 again through the four-way switching valve 10 and the accumulator 7.

(3) Overall Configuration of Outdoor Unit

Figure 2:
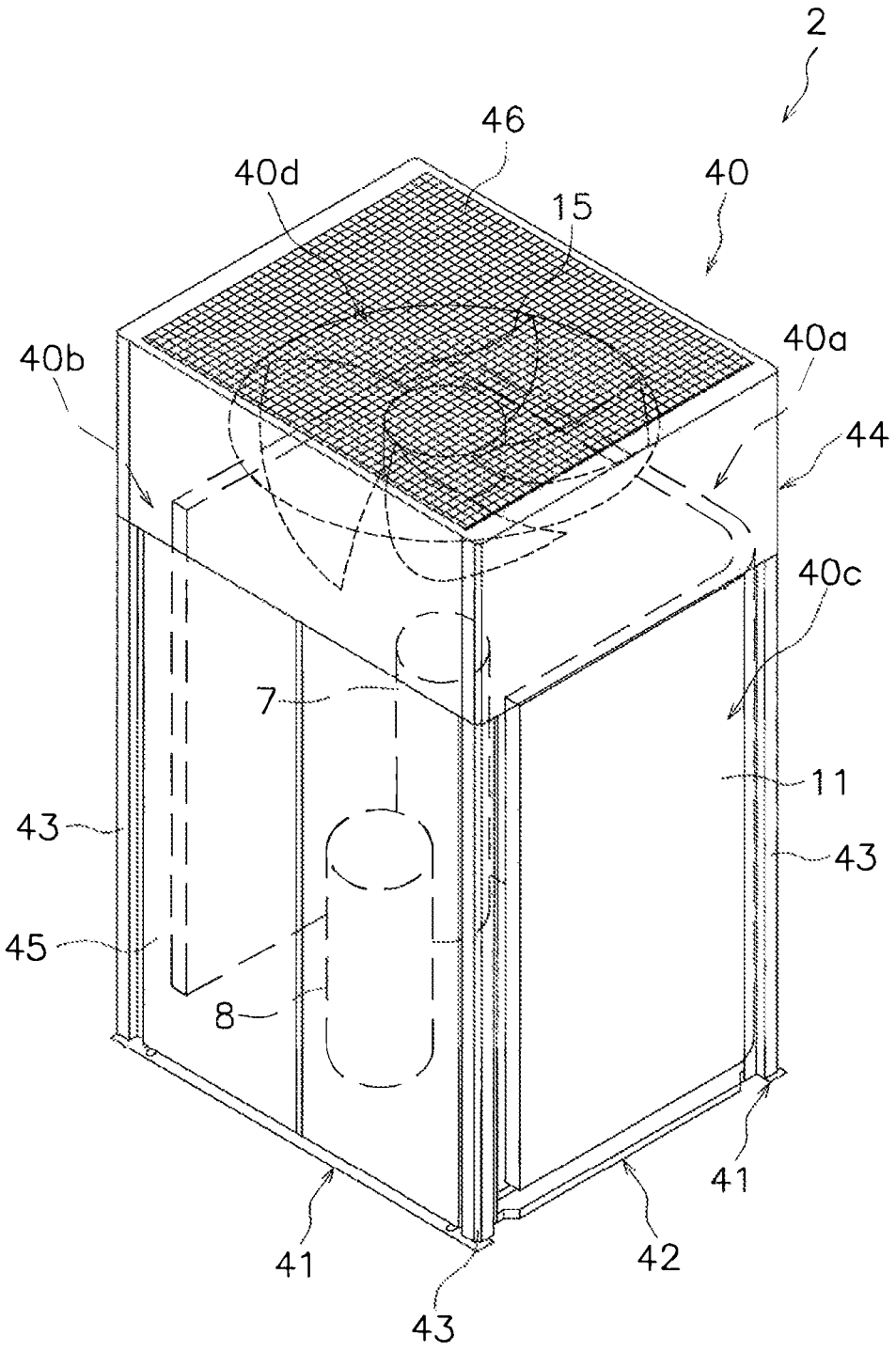
FIG. 2 is an external perspective view of an outdoor unit.
Figure 3:
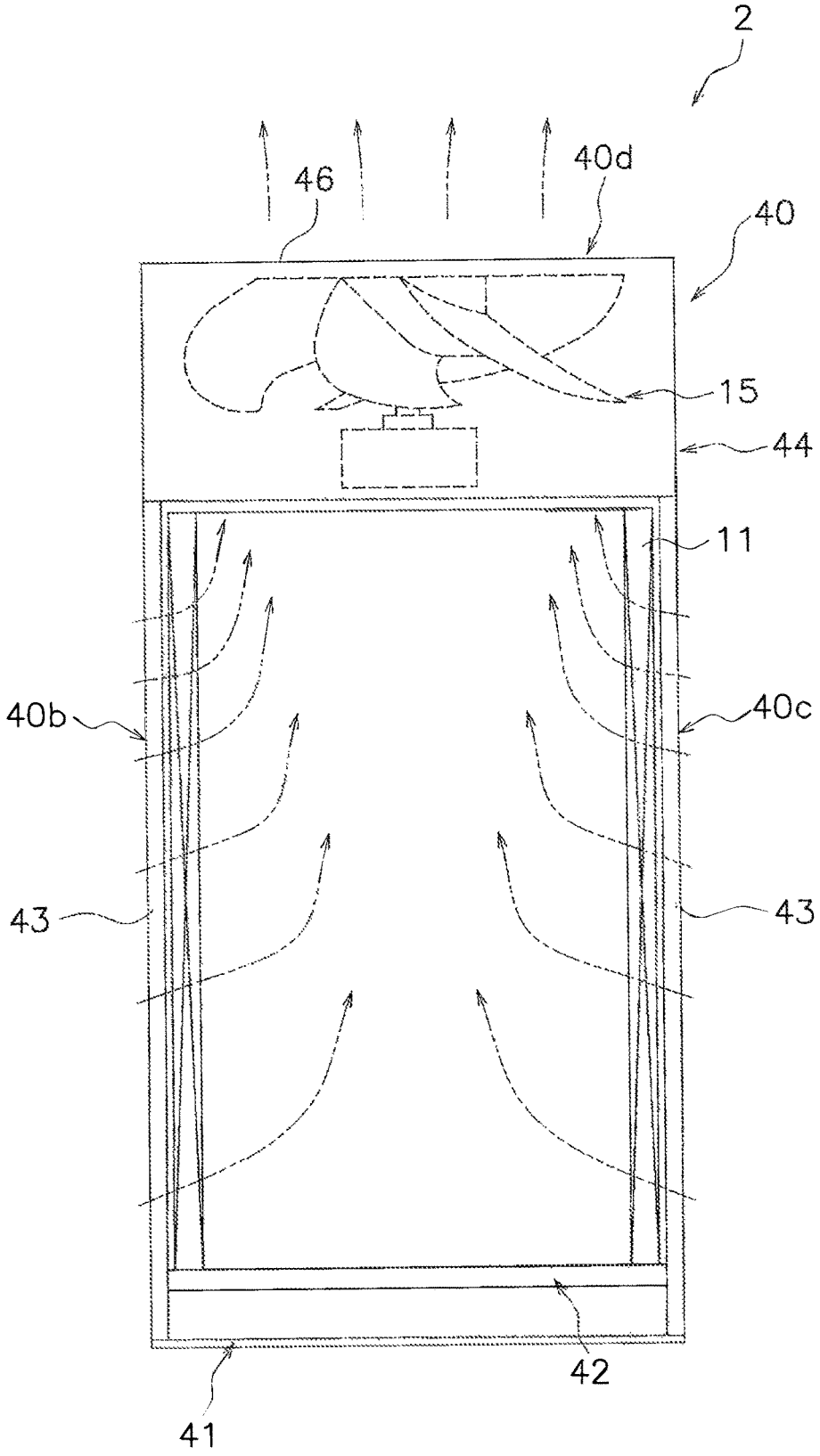
FIG. 3 is a front view of the outdoor unit (shown excluding refrigerant circuit components other than the outdoor heat exchanger).

FIG. 2 is an external perspective view of the outdoor unit 2. FIG. 3 is a front view of the outdoor unit 2 (excluding the refrigerant circuit components other than the outdoor heat exchanger 11).

The outdoor unit 2 is a top-blowing heat exchange unit that sucks air from the side surface of the casing 40 and blows air from the top surface of the casing 40. The outdoor unit 2 mainly includes a casing 40 having a substantially rectangular parallelepiped box shape, an outdoor fan 15 as a blower, and refrigerant circuit components constituting part of the refrigerant circuit 6 and including devices 7, 8, and 11 such as a compressor and an outdoor heat exchanger, valves 10 and 12 to 14 such as a four-way switching valve and an outdoor expansion valve, and refrigerant pipes 16 to 22, and the like. In the following description, "up", "down", "left", "right", "front", "rear", "front surface", and "back surface" mean directions when the outdoor unit 2 shown in FIG. 2 is viewed from the front side (from the front left of the drawing) unless otherwise specified.

The casing 40 mainly includes a bottom frame 42 spanned over a pair of mounting legs 41 extending in the left-right direction, a support 43 extending vertically from a corner of the bottom frame 42, a fan module 44 attached to an upper end of the support 43, and a front panel 45. Air inlets 40*a*, 40*b*, and 40*c* are formed on side surfaces (here, the rear surface and left and right side surfaces) and an air outlet 40*d* is formed on the top surface.

The bottom frame 42 forms the bottom surface of the casing 40, and the outdoor heat exchanger 11 is provided on the bottom frame 42. Here, the outdoor heat exchanger 11 is a substantially U-shaped heat exchanger in a plan view facing the back surface and the left and right side surfaces of the casing 40, and substantially forms the back surface and the left and right side surfaces of the casing 40. Further, the bottom frame 42 is in contact with the lower end portion of the outdoor heat exchanger 11, and functions as a drain pan for receiving drain water generated in the outdoor heat exchanger 11 during cooling operation or defrosting operation.

On the upper side of the outdoor heat exchanger 11, a fan module 44 is provided, which forms portions of the front surface, back surface, and left and right both side surfaces of the casing 40 above the supports 43, and a top surface of the casing 40. Here, the fan module 44 is an assembly in which the outdoor fan 15 is housed in a substantially rectangular parallelepiped box body whose upper and lower surfaces are open. The opening on the top surface of the fan module 44 is an outlet 40*d*, and an outlet grill 46 is provided to the outlet 40*d*. The outdoor fan 15 is disposed in the casing 40 so as to face the outlet 40*d*, and is a blower that takes air into the casing 40 from the inlets 40*a*, 40*b*, and 40*c* and discharges air from the outlet 40*d*.

The front panel 45 is bridged between the supports 43 on the front surface side, and forms the front surface of the casing 40.

In the casing 40, refrigerant circuit components other than the outdoor fan 15 and the outdoor heat exchanger 11 (the accumulator 7 and the compressor 8 are shown in FIG. 2) are also accommodated. Here, the compressor 8 and the accumulator 7 are provided on the bottom frame 42.

(4) Outdoor Heat Exchanger

<Configuration>

Figure 4:
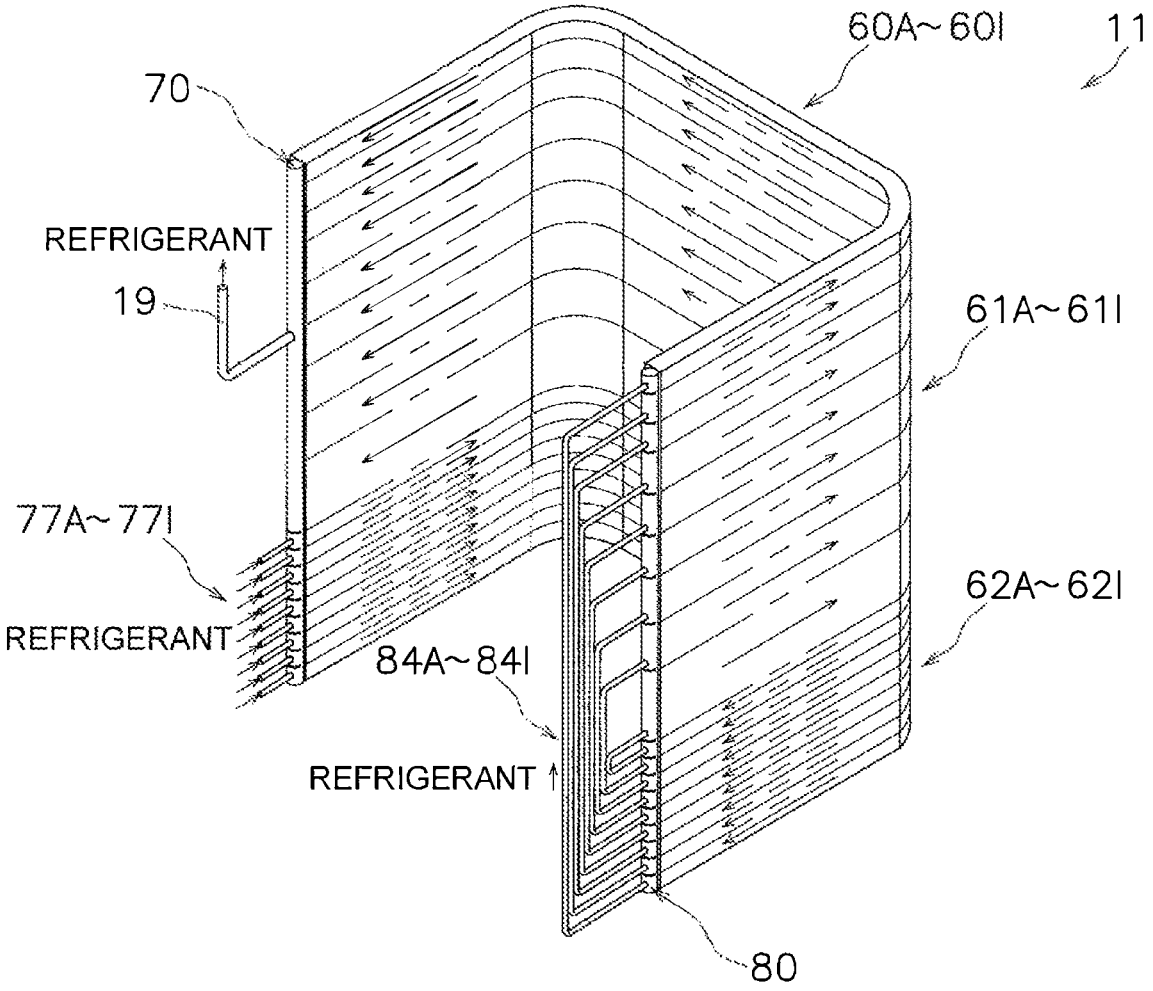
FIG. 4 is a schematic perspective view of an outdoor heat exchanger.
Figure 5:
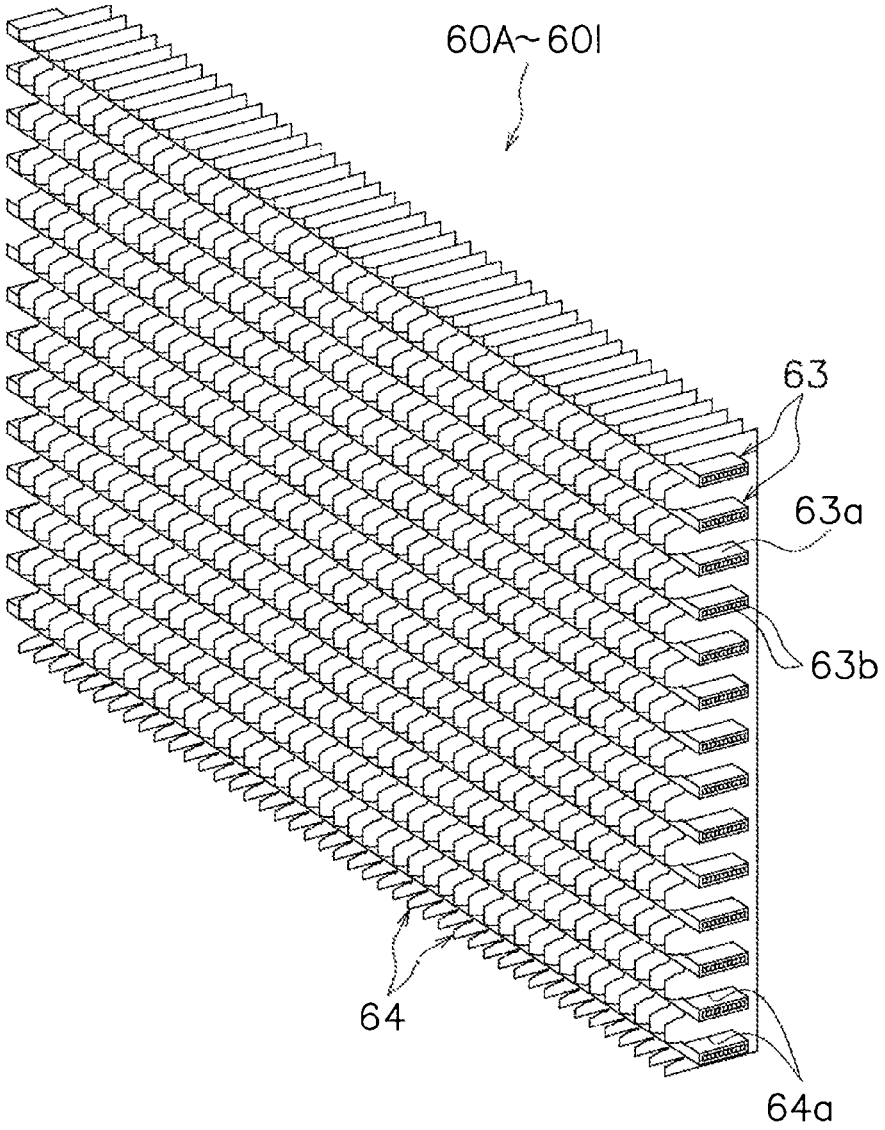
FIG. 5 is a partially enlarged perspective view of a heat exchange unit in FIG. 4.
Figure 6:
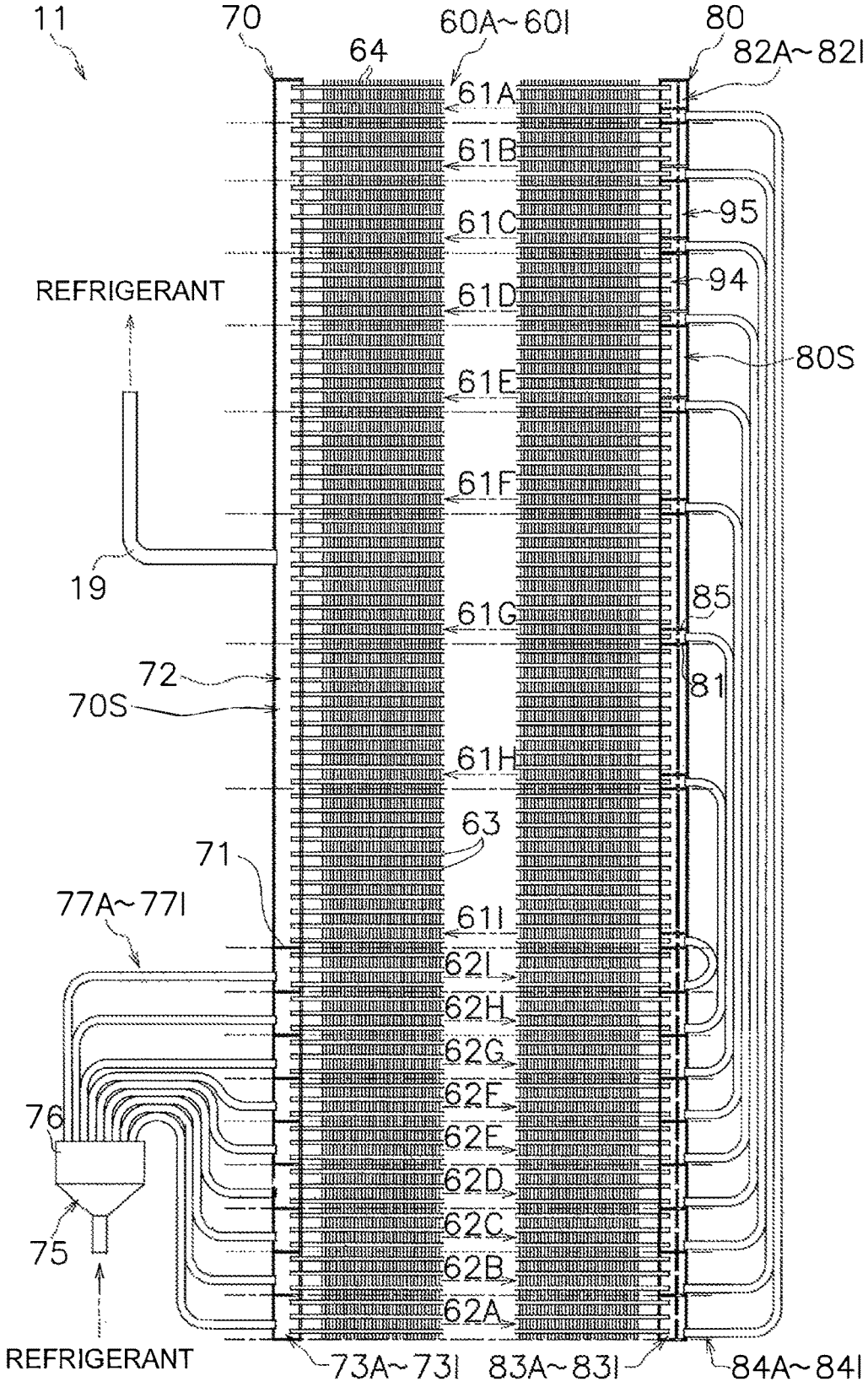
FIG. 6 is a schematic sectional view of the outdoor heat exchanger of FIG. 4.
Figure 7:
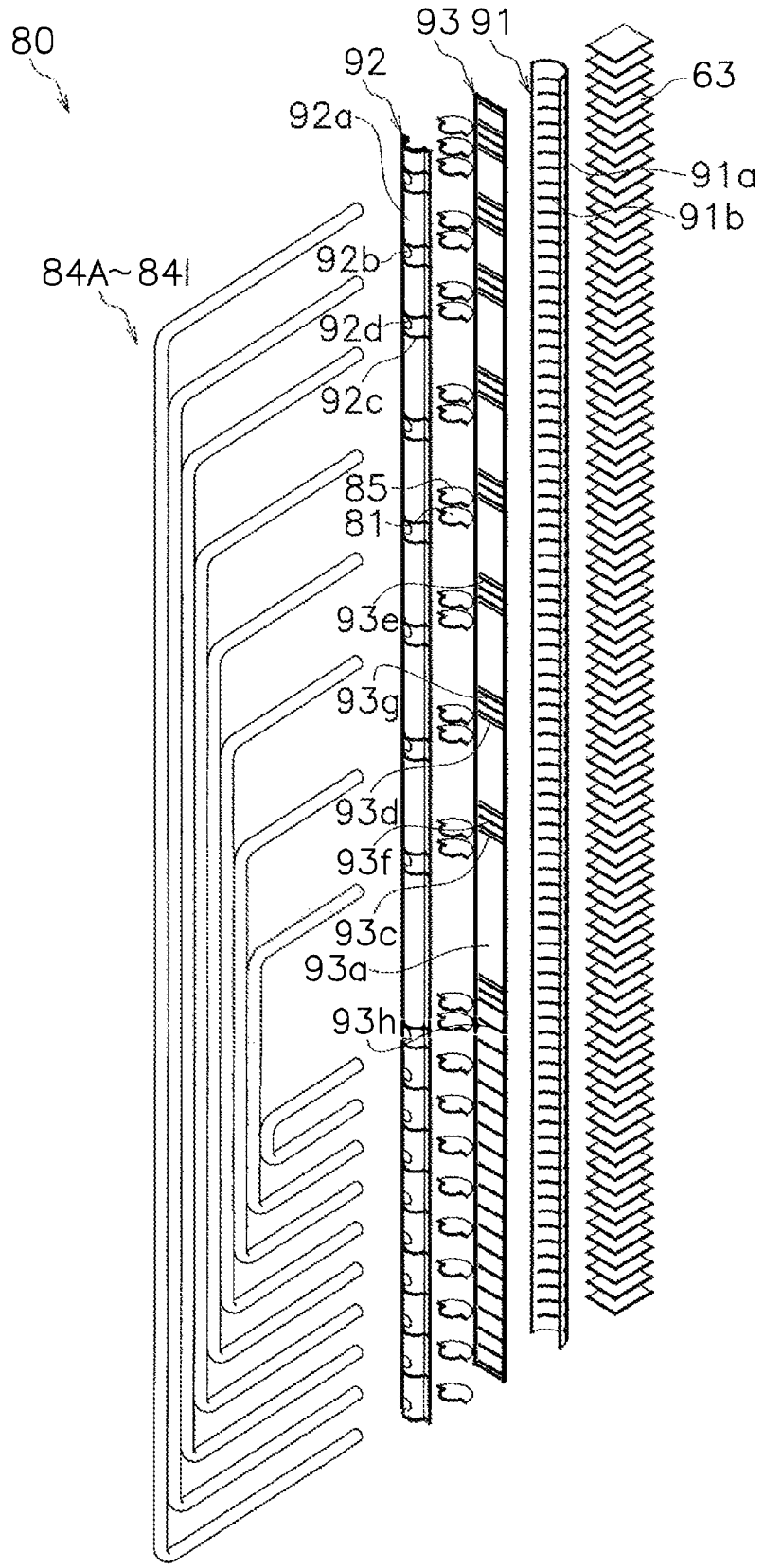
FIG. 7 is an exploded perspective view of the vicinity of a turn-back header collecting pipe in FIGS. 4 and 5.
Figure 8:
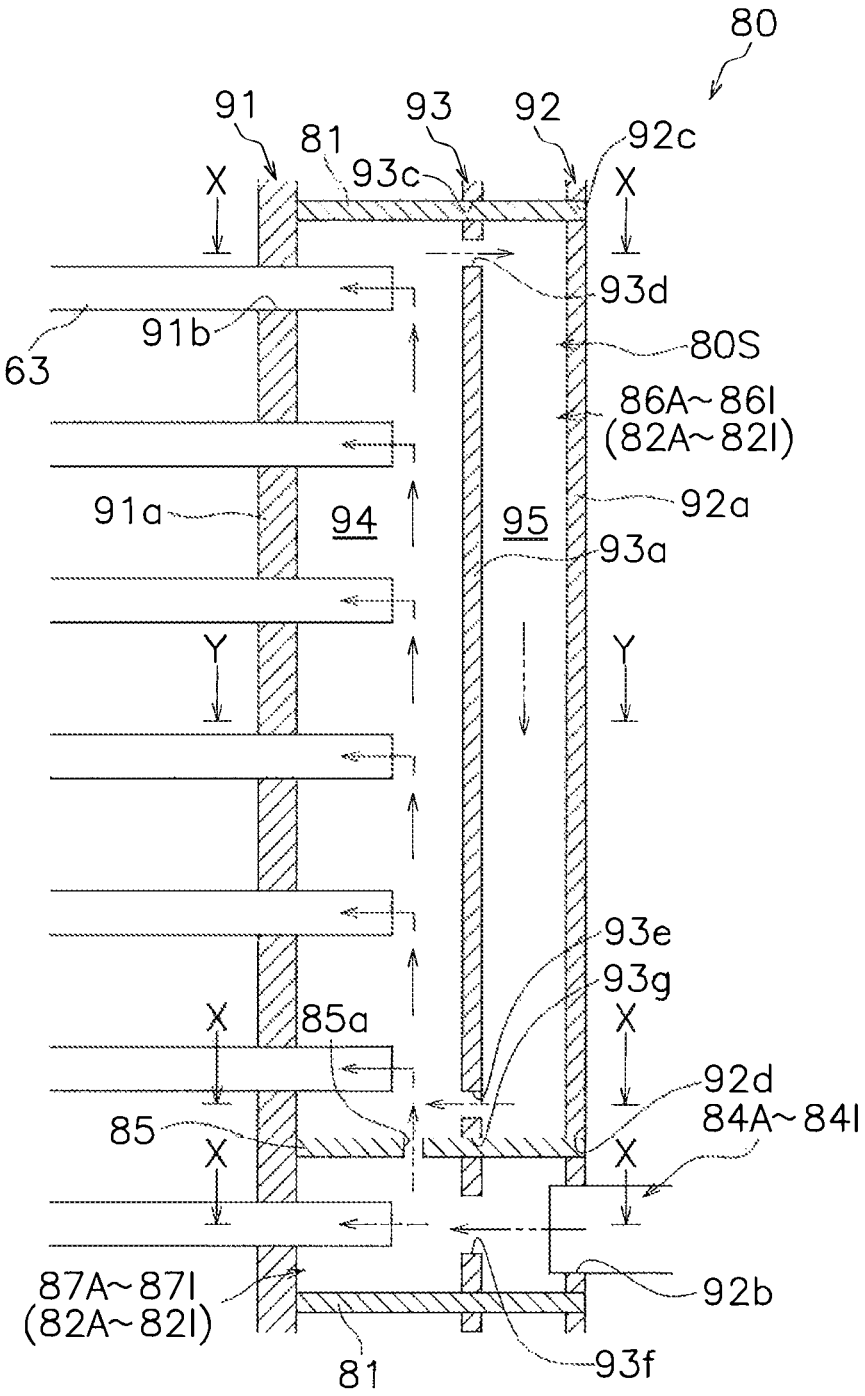
FIG. 8 is an enlarged sectional view of the vicinity of the upper turn-back space in FIGS. 6 and 7.
Figure 9:
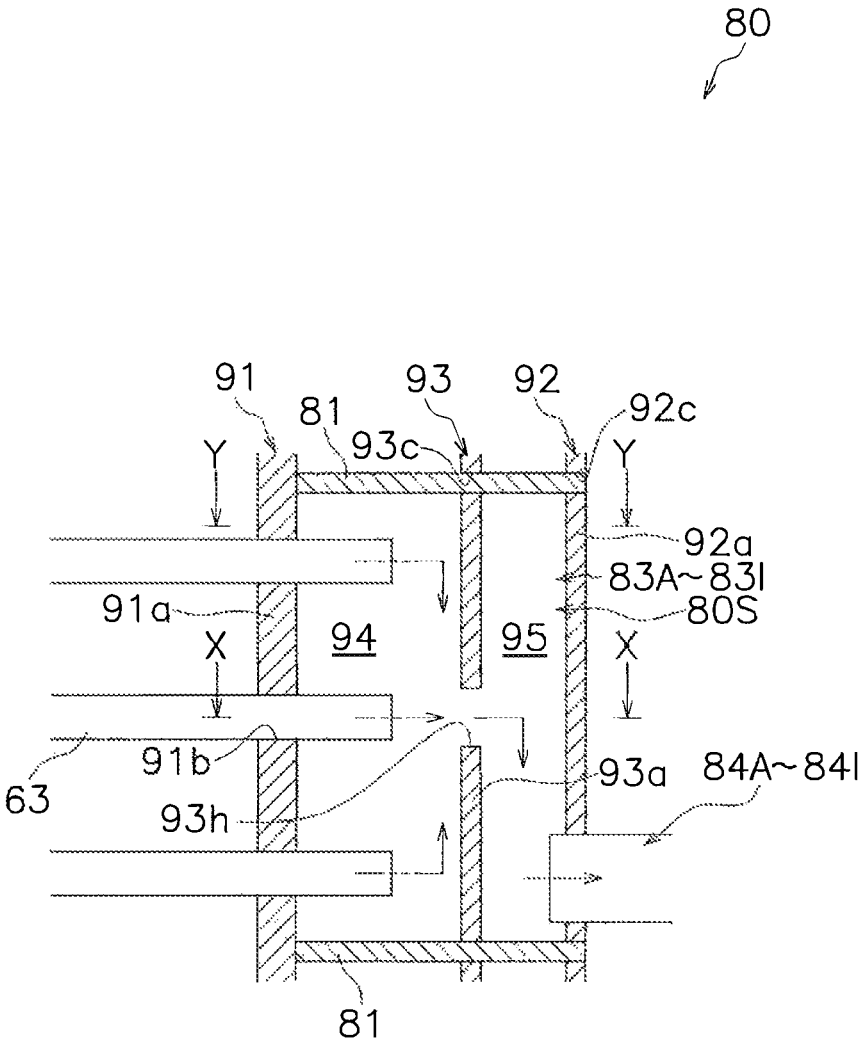
FIG. 9 is an enlarged sectional view of the vicinity of the lower turn-back space in FIGS. 6 and 7.
Figure 10:
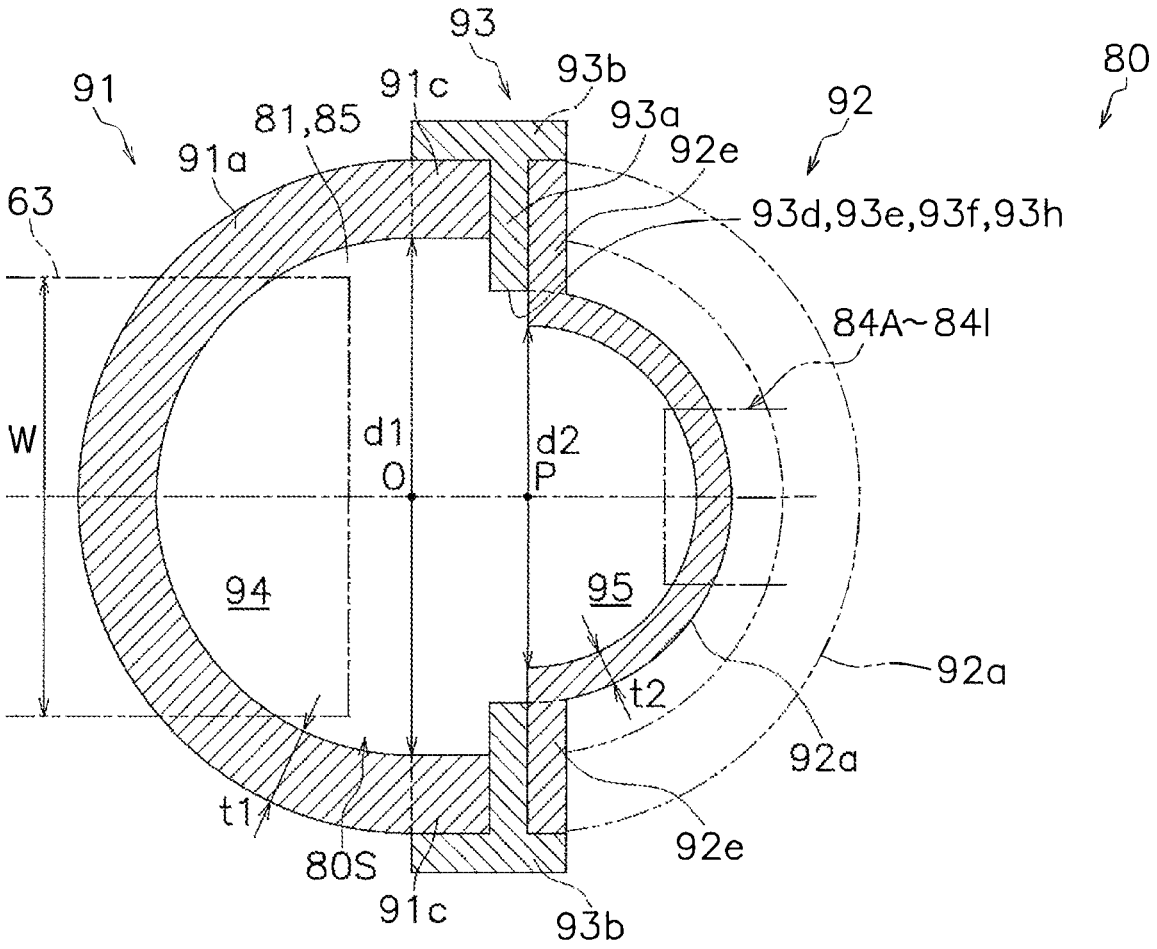
FIG. 10 is a sectional view taken along line X-X of FIGS. 8 and 9 (a flat pipe and a communication pipe are shown by two-dot chain lines).
Figure 11:
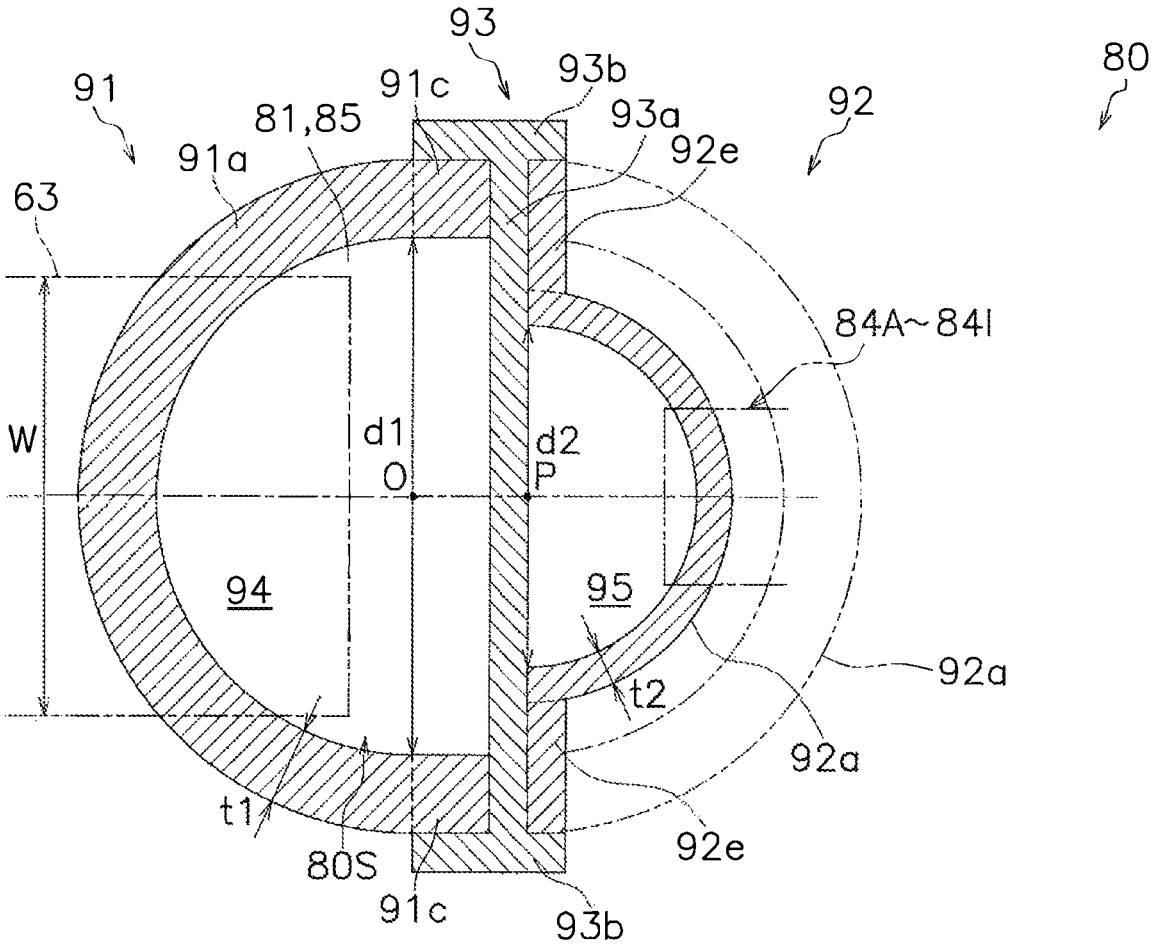
FIG. 11 is a sectional view taken along line Y-Y in FIGS. 8 and 9 (a flat pipe and a communication pipe are shown by two-dot chain lines).

FIG. 4 is a schematic perspective view of the outdoor heat exchanger 11. FIG. 5 is a partially enlarged perspective view of the heat exchange units 60A to 60I of FIG. 4. FIG. 6 is a schematic sectional view of the outdoor heat exchanger 11 of FIG. 4. FIG. 7 is an exploded perspective view of the vicinity of the turn-back header collecting pipe 80 in FIGS. 4 and 5. FIG. 8 is an enlarged sectional view of the vicinity of the upper turn-back spaces 82A to 82I of FIGS. 6 and 7. FIG. 9 is an enlarged sectional view of the vicinity of the lower turn-back spaces 83A to 83I of FIGS. 6 and 7. FIG. 10 is a sectional view taken along line X-X of FIGS. 8 and 9 (the flat pipe 63 and the communication pipes 84A to 84I are shown by two-dot chain lines). FIG. 11 is a sectional view taken along line Y-Y of FIGS. 8 and 9 (the flat pipe 63 and the communication pipes 84A to 84I are shown by two-dot chain lines). The arrows indicating the flow of the refrigerant in FIGS. 4, 6, 8, and 9 indicate the flow direction of the refrigerant during the heating operation (when the outdoor heat exchanger 11 functions as an evaporator for the refrigerant).

The outdoor heat exchanger 11 is a heat exchanger that exchanges heat between the refrigerant and the outdoor air, and mainly includes an inlet/outlet header collecting pipe 70, a turn-back header collecting pipe 80, a plurality of flat pipes 63, and a plurality of fins 64. Here, the inlet/outlet header collecting pipe 70, the turn-back header collecting pipe 80, the connection header 90, the flat pipes 63, and the fins 64 are all made of aluminum or an aluminum alloy, and are joined to each other by brazing or the like.

The inlet/outlet header collecting pipe 70 is a vertically long hollow cylindrical member with closed upper and lower ends. The inlet/outlet header collecting pipe 70 is provided upright on one end side of the outdoor heat exchanger 11 (here, the left front end side in FIG. 4 or the left end side in FIG. 6).

The turn-back header collecting pipe 80 is a vertically long hollow cylindrical member with closed upper and lower ends. The turn-back header collecting pipe 80 is provided upright at the other end side of the outdoor heat exchanger 11 (here, the right front end side in FIG. 4 or the right end side in FIG. 7).

The flat pipe 63 is a flat multi-hole pipe having a vertically oriented flat portion 63*a* serving as a heat transfer surface, and a passage 63*b* formed therein and including a large number of small through holes through which refrigerant flows. The flat pipes 63 are arranged in multiple stages along the up-down direction (step direction). One end of the flat pipe 63 (the left front end in FIG. 4 or the left end in FIG. 6) is connected to the inlet/outlet header collecting pipe 70, and the other end (the right front end in FIG. 4 or the right end in FIG. 6) connected to the turn-back header collecting pipe 80. That is, the header collecting pipes 70 and 80 are connected with the flat pipes 63 and extend in the up-down direction (the step direction). The fins 64 partition the space between adjacent flat pipes 63 into a plurality of ventilation paths through which air flows, and have a plurality of horizontally elongated notches 64*a* formed so that the plurality of flat pipes 63 can be inserted. Here, the direction in which the flat portion 63*a* of the flat pipe 63 faces is the up-down direction (step direction), and the longitudinal direction of the flat pipe 63 is the horizontal direction along the side surface (here, the left and right side surfaces) and the back surface of the casing 40. Therefore, the direction in which the notch 64*a* extends is a horizontal direction that intersects the longitudinal direction of the flat pipe 63. The shape of the notch 64*a* of the fin 64 substantially matches the outer shape of the cross section of the flat pipe 63. The notches 64*a* of the fins 64 are formed at predetermined intervals in the up-down direction (step direction) of the fins 64.

In the outdoor heat exchanger 11, the flat pipes 63 are divided into a plurality of (here, nine) main heat exchange units 61A to 61I arranged in a plurality of stages vertically, and a plurality (here, nine) of sub heat exchange units 62A to 62I arranged in a plurality of stages vertically below the main heat exchange units 61A to 61I. The main heat exchange units 61A to 61I constitute the upper part of the outdoor heat exchanger 11, and the main heat exchange unit 61A is arranged at the uppermost stage thereof. The main heat exchange units 61B to 61I are arranged downward in this order along the vertical direction (stage direction) from below the main heat exchange unit 61A. The sub heat exchange units 62A to 62I constitute the lower part of the outdoor heat exchanger 11, and the sub heat exchange unit 62A is arranged at the lowest stage thereof. The sub heat exchange units 62B to 62I are arranged in this order along the vertical direction (stage direction) from above the sub heat exchange unit 62A.

In the inlet/outlet header collecting pipe 70, the internal space 70S thereof is divided by a partition plate 71 in the up-down direction (step direction) into a gas-side inlet/outlet space 72 common to the main heat exchange units 61A to 61I and liquid-side inlet/outlet spaces 73A to 73I corresponding to the sub heat exchange units 62A to 62I. The gas-side inlet/outlet space 72 communicates with one end of the flat pipe 63 constituting the main heat exchange units 61A to 61I. Each of the liquid-side inlet/outlet spaces 73A-73I communicates with one end of the flat pipe 63 constituting the corresponding sub heat exchange units 62A-62I. The inlet/outlet header collecting pipe 70 is connected with a liquid-side branch member 75 for diverting the refrigerant sent from the outdoor expansion valve 12 (see FIG. 1) to each of the liquid-side inlet/outlet spaces 73A to 73I during the heating operation, and a refrigerant pipe 19 that sends the refrigerant sent from the compressor 8 (see FIG. 1) to the gas-side inlet/outlet space 72 during the cooling operation. The liquid-side branch member 75 includes the liquid-side refrigerant flow divider 76 connected to the refrigerant pipe 20 (see FIG. 1), and the liquid-side refrigerant branch pipes 77A to 77I extending from the liquid-side refrigerant flow divider 76 and connected to the respective liquid-side inlet/outlet spaces 73A to 73I.

The turn-back header collecting pipe 80 mainly has a flat pipe-side header forming member 91 to which the flat pipe 63 is inserted, and an opposite-side header forming member 92 that faces the flat pipe-side header forming member 91 and forms an internal space 80S between the opposite-side header forming member 92 and the flat pipe-side header forming member 91. The turn-back header collecting pipe 80 further includes an intermediate-side header forming member 93 interposed between the flat pipe-side header forming member 91 and the opposite-side header forming member 92. The flat pipe-side header forming member 91 is joined to the intermediate-side header forming member 93 by brazing or the like. The opposite-side header forming member 92 is also joined to the intermediate-side header forming member 93 by brazing or the like.

In the turn-back header collecting pipe 80, the internal space 80S thereof is partitioned by a partition plate 81 in the up-down direction (a step direction) into upper turn-back spaces 82A to 82I corresponding to the respective main heat exchange units 61A to 61I and lower turn-back spaces 83A to 83I corresponding to the respective sub heat exchange units 62A to 62I. The upper turn-back spaces 82A to 82I and the lower turn-back spaces 83A to 83I communicate with each other via communication pipes 84A to 84I.

The flat pipe-side header forming member 91 has a flat pipe-side curved portion 91*a* that protrudes toward the flat pipe 63 side when viewed in the up-down direction (step direction). The flat pipe-side curved portion 91*a* has a semicircular arc shape when viewed along the up-down direction (step direction). In the flat pipe-side header forming member 91, openings 91*b* for inserting the flat pipes 63 are formed side by side in the up-down direction (step direction).

The opposite-side header forming member 92 has an opposite-side curved portion 92*a* that protrudes toward the side away from the flat pipe 63 when viewed in the up-down direction (step direction). The opposite-side curved portion 92*a* has a semicircular arc shape when viewed along the up-down direction (step direction). The openings 92*b* for inserting the communication pipes 84A to 84I are formed in the opposite-side header forming member 92 so as to correspond to the positions of the upper turn-back spaces 82A to 82I and the lower turn-back spaces 83A to 83I in the up-down direction (step direction). Further, openings 92*c* for inserting the partition plate 81 are formed in the opposite-side header forming member 92 so as to correspond to the positions of the upper turn-back spaces 82A to 82I and the lower turn-back spaces 83A to 83I in the up-down direction (step direction).

The intermediate-side header forming member 93 divides the internal space 80S into a flat pipe-side space 94 on the flat pipe-side header forming member 91 side and an opposite-side space 95 on the opposite-side header forming member 92 side. The intermediate-side header forming member 93 includes a first intermediate-side straight portion 93*a* extending straight in a direction orthogonal to the insertion direction of the flat pipe 63 and the communication pipes 84A to 84I (protruding direction of the flat pipe-side curved portion 91*a* and the opposite-side curved portion 92*a*) when viewed along the up-down direction (step direction). The intermediate-side header forming member 93 includes a second intermediate-side straight portion 93*b* extending straight from both ends of the first intermediate-side straight portion 93*a* toward the insertion direction of the flat pipe 63 and the communication pipes 84A to 84I when viewed along the up-down direction (step direction). Openings 93*c* for inserting the partition plate 81 is formed in the first intermediate-side straight portion 93*a* so as to correspond to the positions of the upper turn-back spaces 82A to 82I and the lower turn-back spaces 83A to 83I in the up-down direction (step direction).

Each of the upper turn-back spaces 82A to 82I is divided in the up-down direction by a rectifying plate 85 having an opening 85*a* penetrating in the up-down direction. In the upper turn-back spaces 82A-82I, the spaces above the rectifying plate 85 are loop-side spaces 86A to 86I for forming a loop structure in which the refrigerant flows back and forth between the flat pipe-side space 94 and the opposite-side space 95, and the spaces below the rectifying plate 85 are communication-side spaces 87A to 87I that communicate with the corresponding communication pipes 84A to 841. The flat pipe-side space 94 and the opposite-side space 95 in each of the loop-side spaces 86A to 86I communicate with each other via the opening 93*d* formed in the first intermediate-side straight portion 93*a* at the upper part thereof. The flat pipe-side space 94 and the opposite-side space 95 in each of the loop-side spaces 86A to 86I communicate with each other via the opening 93*e* formed in the first intermediate-side straight portion 93*a* at the lower part thereof. The flat pipe-side space 94 and the opposite-side space 95 in each of the communication-side spaces 87A to 87I communicate with each other via the opening 93*f* formed in the first intermediate-side straight portion 93*a*. When the outdoor heat exchanger 11 is used as a refrigerant evaporator, in each of the loop-side spaces 86A to 86I, the refrigerant flowing upward in the flat pipe-side space 94 flows so as to turn back from the flat pipe-side space 94 to the opposite-side space 95 through the opening 93*d*, and the refrigerant flowing downward in the opposite-side space 95 flows so as to turn back from the opposite-side space 95 to the flat pipe-side space 94 through the opening 93*e* (loop structure). The opposite-side header forming member 92 has openings 92*d* for inserting the rectifying plates 85, and the intermediate-side header forming member 93 has openings 93*g* for inserting the rectifying plates 85. Note that FIG. 8 illustrates one of the upper turn-back spaces 82A to 82I as a representative example. Here, one of the flat pipes 63 is also inserted in the communication-side spaces 87A to 871. However, all of the flat pipes 63 may be inserted in the loop-side spaces 86A to 86I and any flat pipes 63 may not be inserted in the communication-side spaces 87A to 871.

The flat pipe-side space 94 and the opposite-side space 95 in each of the lower turn-back spaces 83A to 83I communicate with each other via the opening 93*h* formed in the first intermediate-side straight portion 93*a*. The lower turn-back spaces 83A to 83I respectively communicate with corresponding communication pipes 84A to 84I. Note that FIG. 9 illustrates one of the lower turn-back spaces 83A to 83I as a representative example.

Next, the shapes of the flat pipe-side header forming member 91, the opposite-side header forming member 92, and the intermediate-side header forming member 93 will be described in detail.

The flat pipe-side curved portion 91*a* of the flat pipe-side header forming member 91 has a semicircular arc shape with an inner diameter d1 when viewed along the up-down direction (step direction). Here, the center of the semicircular arc shape of the flat pipe-side curved portion 91*a* is assumed to be O. The inner diameter d1 of the flat pipe-side curved portion 91*a* is larger than the width W of the flat pipe 63. The flat pipe-side header forming member 91 includes a flat pipe-side straight portion 91*c* that extends from the end of the flat pipe-side curved portion 91*a* toward the insertion direction of the flat pipe 63 (the direction in which the opposite-side curved portion 92*a* protrudes) when viewed along the up-down direction (step direction). An end face, on the side of the insertion direction of the flat pipe 63 (protruding direction of the opposite-side curved portion 92*a*), of the flat pipe-side straight portion 91*c* is connected to a surface, on the side of the insertion direction of the communication pipes 84A to 84I (protruding direction of the flat pipe-side curved portion 91*a*), of the first intermediate-side straight portion 93*a* of the intermediate-side header forming member 93. The outer surface of the flat pipe-side straight portion 91*c* is in contact with the inner surface of the second intermediate-side straight portion 93*b* of the intermediate-side header forming member 93. The contact surfaces of the flat pipe-side straight portion 91*c* and the intermediate-side header forming member 93 are joined to each other by brazing or the like. The thickness of the flat pipe-side header forming member 91 is t1.

The opposite-side curved portion 92*a* of the opposite-side header forming member 92 has a semicircular arc shape with an inner diameter d2 when viewed along the up-down direction (step direction). Here, the center of the semicircular arc shape of the opposite-side curved portion 92*a* is assumed to be P. The inner diameter d2 of the opposite-side curved portion 92*a* is smaller than the inner diameter d1 of the flat pipe-side curved portion 91*a*. Here, the inner diameter d2 of the opposite-side curved portion 92*a* is set to 0.5 to 0.75 times the inner diameter d1 of the flat pipe-side curved portion 91*a*. The inner diameter d2 of the opposite-side curved portion 92*a* is smaller than the width W of the flat pipe 63. The opposite-side header forming member 92 has an opposite-side straight portion 92*e* that extends straight from an end of the opposite-side curved portion 92*a* when viewed in the up-down direction (step direction). Here, when viewed along the up-down direction (the step direction), the opposite-side straight portion 92*e* extends so as to be away from the center P in a direction orthogonal to the insertion direction of the flat pipe 63 and the communication pipes 84A to 84I (protruding direction of the flat pipe-side curved portion 91*a* and the opposite-side curved portion 92*a*). A surface of the opposite-side straight portion 92*e*, on the side of the insertion direction of the communication pipes 84A to 84I (protruding direction of the flat pipe-side curved portion 91*a*), is in contact with a surface, on the side of the insertion direction of the flat pipe 63 (protruding direction of the opposite-side curved portion 92*a*), of the first intermediate-side straight portion 93*a* of the intermediate-side header forming member 93. Here, the first intermediate-side straight portion 93*a* of the intermediate-side header forming member 93 has, as described above, the openings 93*d*, 93*e*, 93*f*, and 93*f* for allowing the flat pipe-side space 94 and the opposite-side space 95, constituting the internal space 80S, to communicate with each other. These openings 93*d*, 93*e*, 93*f*, and 93*f* are formed so that the opposite-side straight portion 92*e* does not face the internal space 80S. Specifically, the openings 93*d*, 93*e*, 93*f*, and 93*f* are formed up to the end of the opposite-side curved portion 92*a* when viewed along the up-down direction (step direction) so that the opposite-side straight portion 92*e* does not face the internal space 80S. The end face of the opposite-side straight portion 92*e* in the direction orthogonal to the insertion direction of the flat pipe 63 and the communication pipes 84A to 84I is in contact with the inner surface of the second intermediate-side straight portion 93*b* of the intermediate-side header forming member 93. The contact surfaces of the opposite-side straight portion 92*e* and the intermediate-side header forming member 93 are joined to each other by brazing or the like. The thickness of the opposite-side header forming member 92 is t2. The thickness t2 of the opposite-side header forming member 92 is smaller than the thickness t1 of the flat pipe-side header forming member 91.

<Operation (Flow of Refrigerant)>

Next, the flow of the refrigerant in the outdoor heat exchanger 11 having the above configuration will be described.

During the cooling operation, the outdoor heat exchanger 11 functions as a radiator for the refrigerant discharged from the compressor 8 (see FIG. 1). Here, the refrigerant flows in the direction opposite to the arrow indicating the flow of the refrigerant in FIGS. 4, 6, 8, and 9.

The refrigerant discharged from the compressor 8 (see FIG. 1) is sent to the gas-side inlet/outlet space 72 of the inlet/outlet header collecting pipe 70 through the refrigerant pipe 19.

The refrigerant sent to the gas-side inlet/outlet space 72 is diverted to the flat pipes 63 constituting the main heat exchange units 61A to 61I of the heat exchange units 60A to 601. The refrigerant sent to the flat pipes 63 radiates heat by heat exchange with the outdoor air while flowing through the passage 63*b*, and is sent to the upper turn-back spaces 82A to 82I of the turn-back header collecting pipe 80. The refrigerant sent to the upper turn-back spaces 82A to 82I merges through the loop-side spaces 86A to 86I, the openings 93*d*, 93*e*, and 85*a*, the communication-side spaces 87A to 871, and the opening 93*f*, and is sent to the communication pipes 84A to 841. The refrigerant sent to the communication pipes 84A to 841 is sent to the lower turn-back spaces 83A to 831. The refrigerant sent to the lower turn-back spaces 83A to 83I is diverted to the flat pipes 63 constituting the sub heat exchange units 62A to 62I of the heat exchange units 60A to 60I through the openings 93*h*. The refrigerant sent to the flat pipes 63 further radiates heat by exchanging heat with the outdoor air while flowing through the passage 63*b*, and is sent to the liquid-side inlet/outlet spaces 73A to 73I of the inlet/outlet header collecting pipe 70 to join. That is, the refrigerant passes through the heat exchange units 60A to 60I in the order of the main heat exchange units 61A to 61I and the sub heat exchange units 62A to 62I. At this time, the refrigerant radiates heat until the state is changed from the superheated gas state to the saturated liquid state or the supercooled liquid state. The refrigerant sent to the liquid-side inlet/outlet spaces 73A to 73I is sent to the liquid-side refrigerant branch pipes 77A to 77I of the liquid-side refrigerant flow dividing member 75, and joins in the liquid-side refrigerant flow divider 76. The refrigerant that has joined in the liquid-side refrigerant flow divider 76 is sent to the outdoor expansion valve 12 (see FIG. 1) through the refrigerant pipe 20 (see FIG. 1).

During the heating operation, the outdoor heat exchanger 11 functions as an evaporator for the refrigerant decompressed by the outdoor expansion valve 12 (see FIG. 1). Here, the refrigerant flows in the direction of the arrow indicating the flow of the refrigerant in FIGS. 4, 6, 8, and 9.

The refrigerant decompressed in the outdoor expansion valve 12 is sent to the liquid-side refrigerant flow dividing member 75 through the refrigerant pipe 20 (see FIG. 1). The refrigerant sent to the liquid-side refrigerant flow dividing member 75 is diverted from the liquid-side refrigerant flow divider 76 to the liquid-side refrigerant branch pipes 77A to 77I, and is sent to the liquid-side inlet/outlet spaces 73A to 73I of the inlet/outlet header collecting pipe 70.

The refrigerant sent to the liquid side inlet/outlet spaces 73A to 73I is diverted to the flat pipes 63 constituting the sub heat exchange units 62A to 62I of the heat exchange units 60A to 60I. The refrigerant sent to the flat pipes 63 is heated by heat exchange with the outdoor air while flowing through the passage 63*b*, and is sent to the lower turn-back spaces 83A to 83I of the turn-back header collecting pipe 80 to join. The refrigerant sent to the lower turn-back spaces 83A to 83I is sent to the communication pipes 84A to 84I through the opening 93*h*. The refrigerant sent to the communication pipes 84A to 84I is sent to the upper turn-back spaces 82A to 82I. The refrigerant sent to the upper turn-back spaces 82A to 82I passes through the communication-side spaces 87A to 87I, the openings 93*f* and 85*a*, the loop-side spaces 86A to 86I, and the openings 93*d* and 93*e* to be diverted to the flat pipes 63 constituting the main heat exchange units 61A to 61I of the heat exchange units 60A to 60I. At this time, the refrigerant sent to the communication-side spaces 87A to 87I is sent from the opposite-side space 95 to the flat pipe-side space 94 through the opening 93*f*, and a part thereof is sent to the flat pipes 63 inserted in the communication-side spaces 87A to 87I and the residual is sent to the flat pipe-side space 94 of the loop-side spaces 86A to 86I through the opening 85*a*. The refrigerant sent to the flat pipe-side space 94 flows up the flat pipe-side space 94 while being diverted to the flat pipes 63 inserted in the flat pipe-side space 94, and reaches the upper part of the flat pipe-side space 94. The refrigerant that has reached the upper part of the flat pipe-side space 94 is sent to the upper part of the opposite-side space 95 through the opening 93*d*. The refrigerant sent to the upper part of the opposite-side space 95 flows down the opposite-side space 95 and reaches the lower part of the opposite-side space 95. The refrigerant that has reached the lower part of the opposite-side space 95 is sent to the lower part of the flat pipe-side space 94 through the opening 93*e*, and joins the refrigerant sent to the flat pipe-side space 94 of the loop-side spaces 86A to 86I through the opening 85*a*. As described above, the refrigerant sent from the communication-side spaces 87A to 87I to the loop-side spaces 86A to 86I through the openings 85*a* is diverted to the flat pipes 63 constituting the main heat exchange units 61A to 611, with a flow (loop flow) in which the refrigerant turns back between the flat pipe-side space 94 and the opposite-side space 95. Then, the refrigerant sent to the flat pipes 63 is further heated by heat exchange with the outdoor air while flowing through the passage 63*b*, and is sent to the gas-side inlet/outlet space 72 of the inlet/outlet header collecting pipe 70 to join. That is, the refrigerant passes through the heat exchange units 60A to 60I in the order of the sub heat exchange units 62A to 62I and the main heat exchange units 61A to 61I. At this time, the refrigerant is heated until it evaporates from the liquid state or the gas-liquid two-phase state to a superheated gas state. The refrigerant sent to the gas-side inlet/outlet space 72 is sent through the refrigerant pipe 19 to the suction side of the compressor 8 (see FIG. 1).

(5) Features

The outdoor heat exchanger 11 (heat exchanger) of one or more embodiments and the air conditioner 1 including the same have the features discussed below.

<A>

As described above, the heat exchanger 11 of one or more embodiments includes a plurality of flat pipes 63 arranged side by side in the up-down direction (predetermined step direction) and each having a refrigerant passage 63*b* formed therein, and a turn-back header collecting pipe 80 (header collecting pipe) connected with the flat pipes 63 and extending along the step direction. The header collecting pipe 80 has a flat pipe-side header forming member 91 to which the flat pipes 63 are inserted, and an opposite-side header forming member 92 that faces the flat pipe-side header forming member 91 and forms an internal space 80S between the opposite-side header forming member 92 and the flat pipe-side header forming member 91. The flat pipe-side header forming member 91 has a flat pipe-side curved portion 91*a* protruding toward the flat pipe 93 side when viewed along the step direction. The opposite-side header forming member 92 has an opposite-side curved portion 92*a* protruding toward a side away from the flat pipe 63 when viewed along the step direction. Here, the inner diameter d2 of the opposite-side curved portion 92*a* is smaller than the inner diameter d1 of the flat pipe-side curved portion 91*a*.

Here, the volume of the internal space 80S of the header collecting pipe 80 can be reduced corresponding to the fact that the inner diameter d2 of the opposite-side curved portion 92*a* is smaller than the inner diameter d1 of the flat pipe-side curved portion 91*a*. Thereby, the volume of the heat exchanger 11 can be reduced. For example, compared with the case where the inner diameter d2 of the opposite-side curved portion 92*a* is the same as the inner diameter d1 of the flat pipe-side curved portion 91*a* (refer to the opposite-side curved portion 92*a* indicated by a two-dot chain line in FIGS. 10 and 11), the volume of the opposite-side space 95 can be reduced. In the air conditioner 1 provided with such a heat exchanger 11, since the volume of the heat exchanger 11 can be reduced, the refrigerant can be saved.

<B>

Further, in the heat exchanger 11 of one or more embodiments, as described above, the inner diameter d1 of the flat pipe-side curved portion 91*a* is larger than the width W of the flat pipe 63, and the inner diameter d2 of the opposite-side curved portion 92*a* is smaller than the width W of the flat pipe 63.

Here, the inner diameter d2 of the opposite-side curved portion 92*a* can be significantly smaller than the inner diameter d1 of the flat pipe-side curved portion 91*a*, whereby the volume of the internal space 80S of the header collecting pipe 80 can be significantly reduced.

<C>

Moreover, in the heat exchanger 11 of one or more embodiments, as described above, the header collecting pipe 80 further includes the intermediate-side header forming member 93 interposed between the flat pipe-side header forming member 91 and the opposite-side header forming member 92.

Here, the flat pipe-side header forming member 91 and the opposite-side header forming member 92 can be joined via the intermediate-side header forming member 93.

<D>

Further, in the heat exchanger 11 of one or more embodiments, as described above, the intermediate-side header forming member 93 partitions the internal space 80S into the flat pipe-side space 94 on the flat pipe-side header forming member 91 side, and the opposite-side space 95 of the opposite-side header forming member 92 side. The header collecting pipe 80 has a loop structure in which the refrigerant flows back and forth between the flat pipe-side space 94 and the opposite-side space 95.

Here, when the heat exchanger 11 is used as a refrigerant evaporator, it is possible to suppress a divergent flow when the refrigerant is diverted from the header collecting pipe 80 to the flat pipe 63.

<E>

Further, in the heat exchanger 11 of one or more embodiments, as described above, the inner diameter d2 of the opposite-side curved portion 92*a* is 0.5 to 0.75 times the inner diameter d1 of the flat pipe-side curved portion 91*a*. Here, in the header collecting pipe 80 having a loop structure, when the heat exchanger 11 is used as a refrigerant evaporator, the pressure loss of the refrigerant forming a loop flow that turns back from the flat pipe-side space 94 to the opposite-side space 95 needs to be equal to or smaller than the pressure loss occurring while the refrigerant sent from the communication pipes 84A to 84I to the upper turn-back spaces 82A to 82I is diverted to the flat pipe 63. In order to satisfy this condition, it is necessary to make the volume of the opposite-side space 95 smaller than the volume of the flat pipe-side space 94, while equalizing the pressure loss in both flows. On the other hand, if the inner diameter d2 of the opposite-side curved portion 92*a* is smaller than 0.5 times the inner diameter d1 of the flat pipe-side curved portion 91*a*, the pressure loss in the refrigerant forming the loop flow becomes too large, and a desired loop flow is less likely to be generated. Meanwhile, if the inner diameter d2 of the opposite-side curved portion 92*a* is larger than 0.75 times the inner diameter d1 of the flat pipe-side curved portion 91*a*, the volume of the opposite-side space 95 cannot be reduced much. Therefore, here, as described above, the inner diameter d2 of the opposite-side curved portion 92*a* is set to be 0.5 to 0.75 times the inner diameter d1 of the flat pipe-side curved portion 91*a*.

Here, by making the inner diameter d2 of the opposite-side curved portion 92*a* 0.5 to 0.75 times the inner diameter d1 of the flat pipe-side curved portion 91*a*, it is possible to maintain a favorable flow of the refrigerant turning back between the flat pipe-side space 94 and the opposite-side space 95.

<F>

Further, in the heat exchanger 11 of one or more embodiments, as described above, the opposite-side header forming member 92 further includes the opposite-side straight portion 92*e* that extends straight from the end of the opposite-side curved portion 92*a* when viewed along the step direction. The opposite-side straight portion 92*e* is joined to the intermediate-side header forming member 93.

Here, the pressure resistance of the opposite-side straight portion 92*e* joined to the intermediate-side header forming member 93 can be increased, whereby the pressure resistance of the header collecting pipe 80 can be ensured. That is, although the opposite-side straight portion 92*e* has a lower pressure resistance than the opposite-side curved portion 92*a* having a semicircular arc shape, the substantial wall thickness of the opposite-side straight portion 92*e* can be increased by joining the opposite-side straight portion 92*e* to the intermediate-side header forming member 93. Thereby, the pressure resistance can be increased.

Furthermore, in the heat exchanger 11 of one or more embodiments, the opposite-side straight portion 92*e* does not face the internal space 80S.

Here, the opposite-side straight portion 92*e* is not directly subjected to the internal pressure, and can contribute to securing of the pressure resistance of the header collecting pipe 80.

In the heat exchanger 11 of one or more embodiments, the thickness t2 of the opposite-side header forming member 92 is smaller than the thickness t1 of the flat pipe-side header forming member 91.

Here, the material cost of the opposite-side header forming member 92 can be reduced, and as a result, the cost of the header collecting pipe 80 and, consequently, the heat exchanger 11 can be reduced. In particular, here, the opposite-side straight portion 92*e* having a lower pressure resistance than the semicircular arc shaped opposite-side curved portion 92*a* is joined to the intermediate-side header forming member 93, and does not face the internal space 80S. Therefore, the thickness t2 of the entire opposite-side header forming member 92 including the opposite-side straight portion 92*e* can be reduced to the minimum necessary thickness in the opposite-side curved portion 92*a*.

(6) Modified Example

<A>

In the outdoor heat exchanger 11 (heat exchanger) of one or more embodiments, the loop structure (the rectifying plate 85 having the opening 85*a*, the loop-side spaces 86A to 86I, the communication-side spaces 87A to 871, and the openings 93*d*, 93*e*, and 93*f*) is provided to the upper turn-back spaces 82A to 82I of the return header collecting pipe 80 (header collecting pipe). Therefore, when the heat exchanger 11 is used as a refrigerant evaporator, an uneven flow when the refrigerant is diverted from the header collecting pipe 80 to the flat pipe 63 is suppressed.

Figure 12:
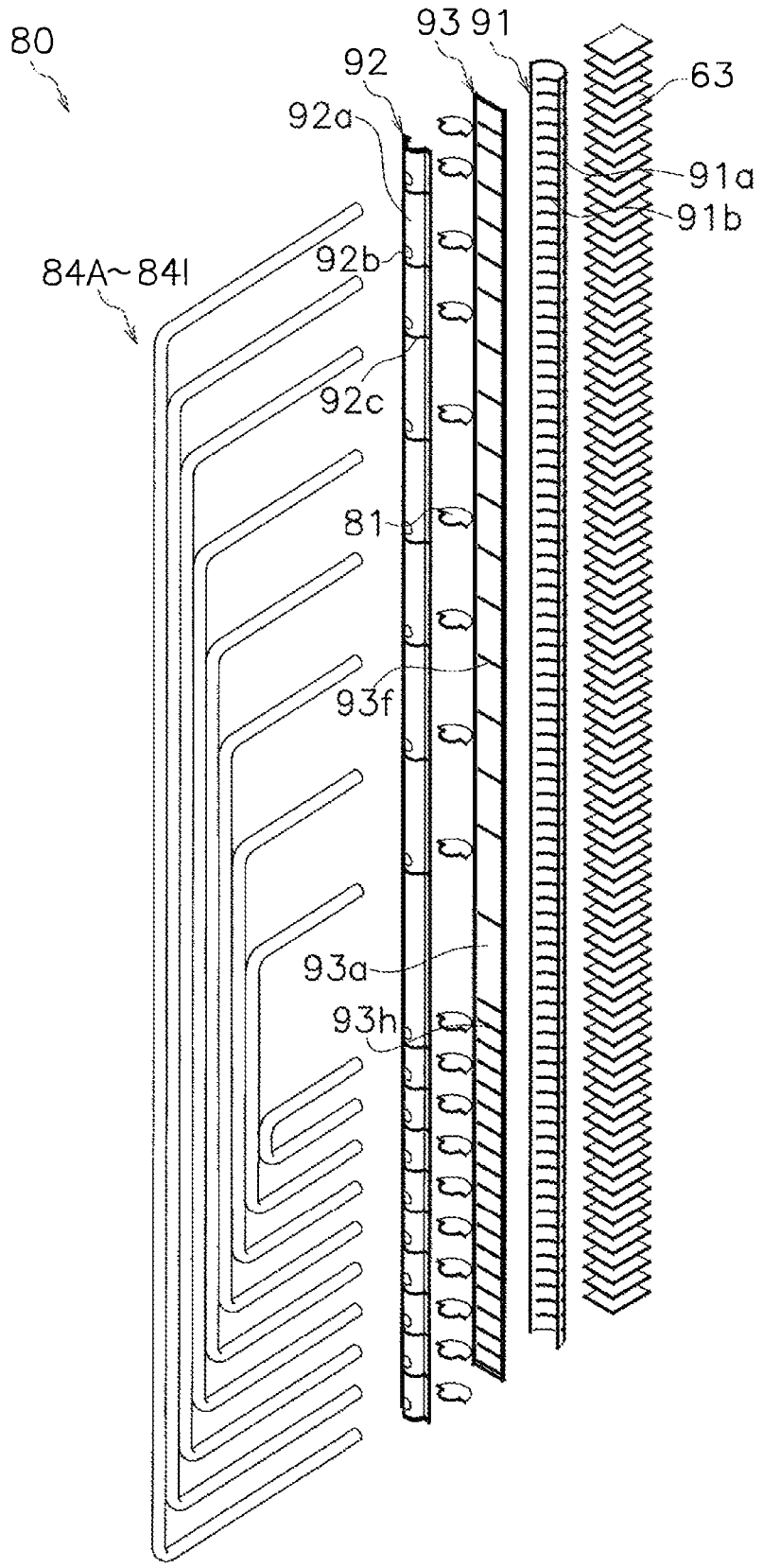
FIG. 12 is an exploded perspective view of the vicinity of a turn-back header collecting pipe of an outdoor heat exchanger as a heat exchanger according to Modification A.
Figure 13:
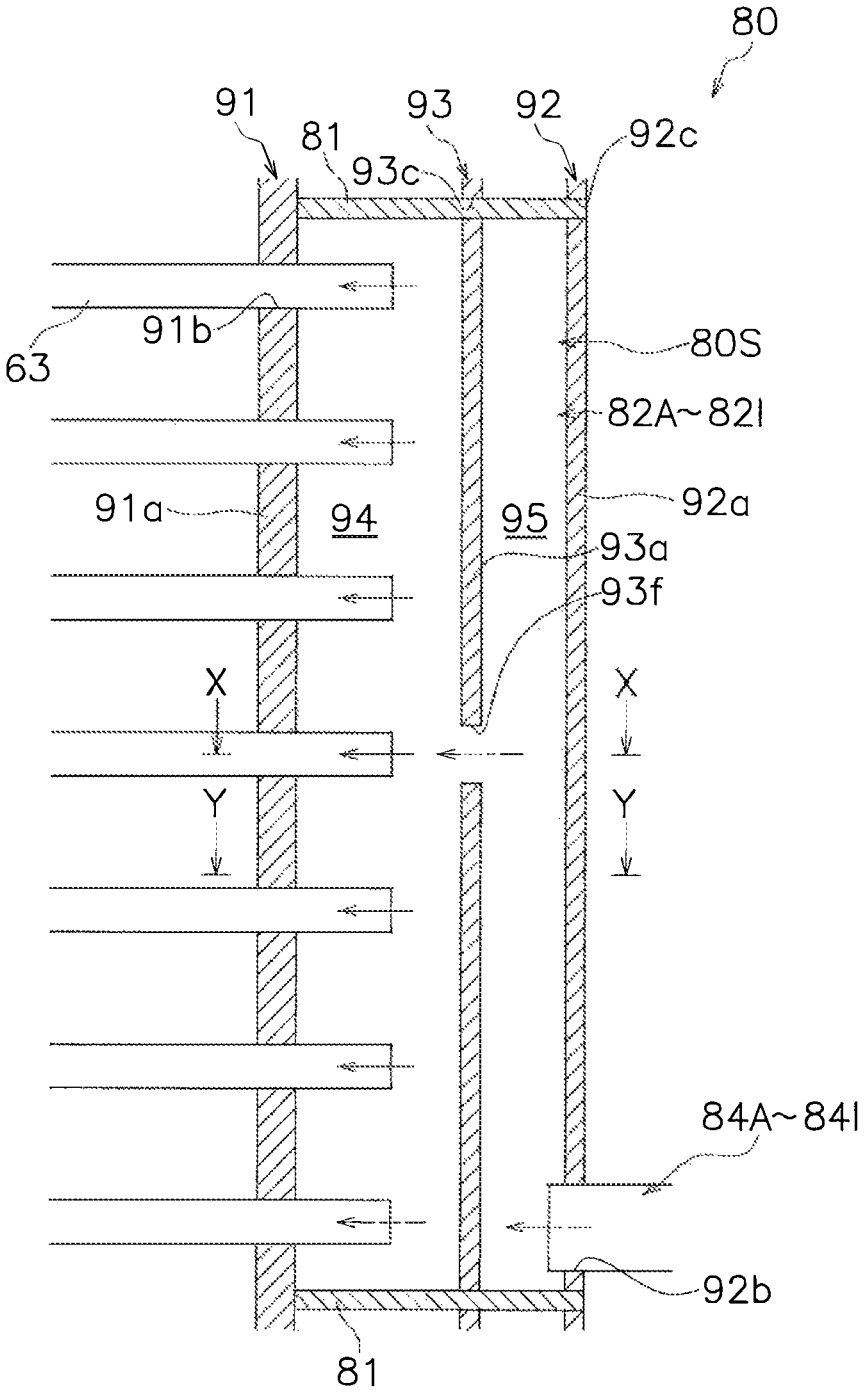
FIG. 13 is an enlarged sectional view of the vicinity of the upper turn-back space in FIG. 12.

However, there is a case where the uneven flow in the upper turn-back spaces 82A to 82I can be suppressed by another configuration, or a slight uneven flow may be allowed. In such a case, as shown in FIGS. 12 and 13, even in the upper turn-back spaces 82A to 82I, it is acceptable to form in the intermediate-side header forming member 93 only the openings 93*f* that allow the flat pipe-side space 94 and the opposite-side space 95 to communicate with each other, similar to the lower turn-back spaces 83A to 831, so that the loop structure is omitted. In that case, the rectifying plates 85 and the openings 92*d* for inserting the rectifying plates 85 into the opposite-side header forming member 92 are also omitted.

Such Modification A also has the features <A>, <B>, <C>, and <F> of the above embodiments.

<B>

In the outdoor heat exchanger 11 (heat exchanger) of the above embodiments and Modification A, the pressure resistance of the turn-back header collecting pipe 80 may be increased. In particular, the pressure resistance of a straight portion from the end of the opposite-side curved portion 92*a* to the opposite-side straight portion 92*e* of the opposite-side header forming member 92 constituting the header collecting pipe 80 may be increased. This is because, for example, when carbon dioxide is used as the refrigerant in the refrigerant circuit 6, the pressure of the refrigerant flowing through the outdoor heat exchanger 11 becomes significantly higher than when HFC refrigerant is used.

Figure 14:
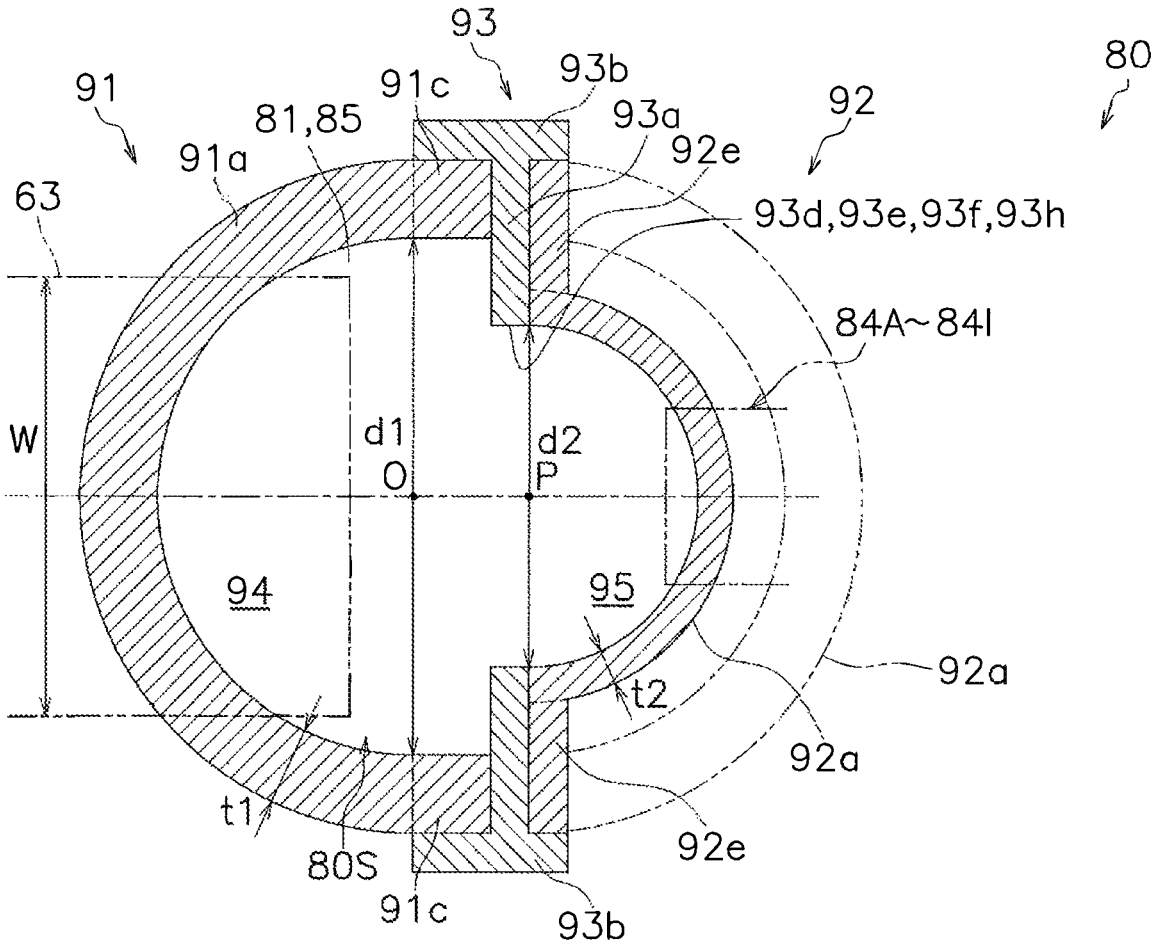
FIG. 14 illustrates an outdoor heat exchanger as a heat exchanger according to Modification B, which corresponds to a sectional view taken along line X-X of FIGS. 8 and 9 (a flat pipe and a communication pipe are shown by two-dot chain lines).

Therefore, here, as shown in FIG. 14, the first intermediate-side straight portion 93*a* of the intermediate-side header forming member 93, which is joined to the opposite-side straight portion 92*e*, is made longer than the opposite-side straight portion 92*e*. Thus, the first intermediate-side straight portion 93*a* is joined to a straight portion extending from the end of the opposite-side curved portion 92*a* to the opposite-side straight portion 92*e*. Here, the lengths of the first intermediate-side straight portion 93*a* and the opposite-side straight portion 92*e* mean the lengths of the first intermediate-side straight portion 93*a* and the opposite-side straight portion 92*e* extending straight from the position of the second intermediate-side straight portion 93*b* in a direction orthogonal to the insertion direction of the flat pipe 63 and the communication pipe 84, when the intermediate-side header forming member 93 and the opposite-side header forming member 92 are viewed along the step direction. Thereby, in this case, the substantial thickness can be increased in a straight portion extending from the end of the opposite-side curved portion 92*a* to the opposite-side straight portion 92*e*.

Thus, here, the pressure resistance of the header collecting pipe 80 can be further increased, and this is particularly useful when high-pressure refrigerant such as carbon dioxide is used.

<C>

In the outdoor heat exchanger 11 (heat exchanger) of the above embodiments and Modifications A and B, the turn-back header collecting pipe 80 (header collecting pipe) has a structure in which the intermediate-side header forming member 93 is interposed between the flat pipe-side header forming member 91 and the opposite-side header forming member 92.

Figure 15:
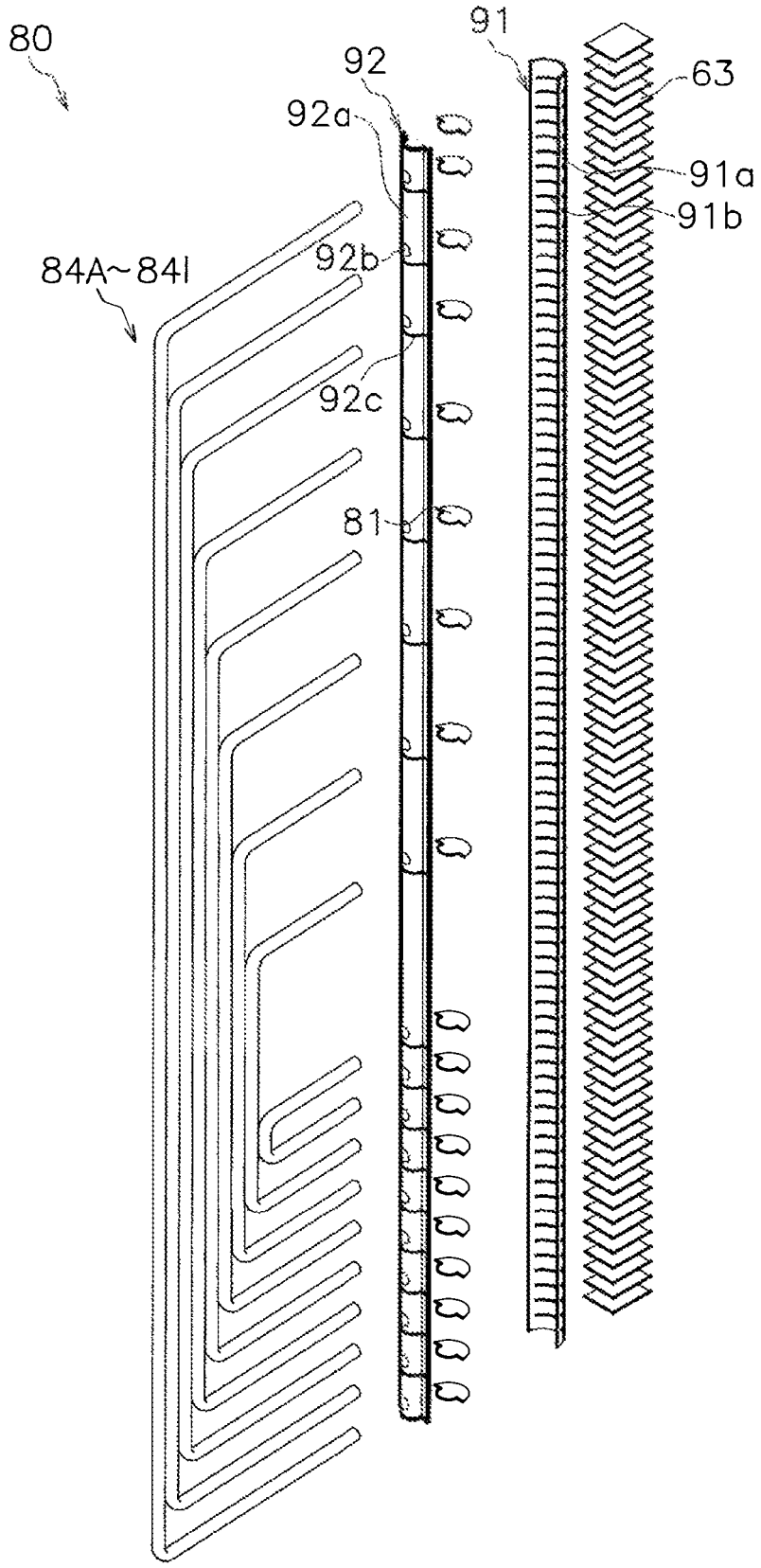
FIG. 15 is an exploded perspective view of the vicinity of a turn-back header collecting pipe of an outdoor heat exchanger as a heat exchanger according to Modification C.
Figure 16:
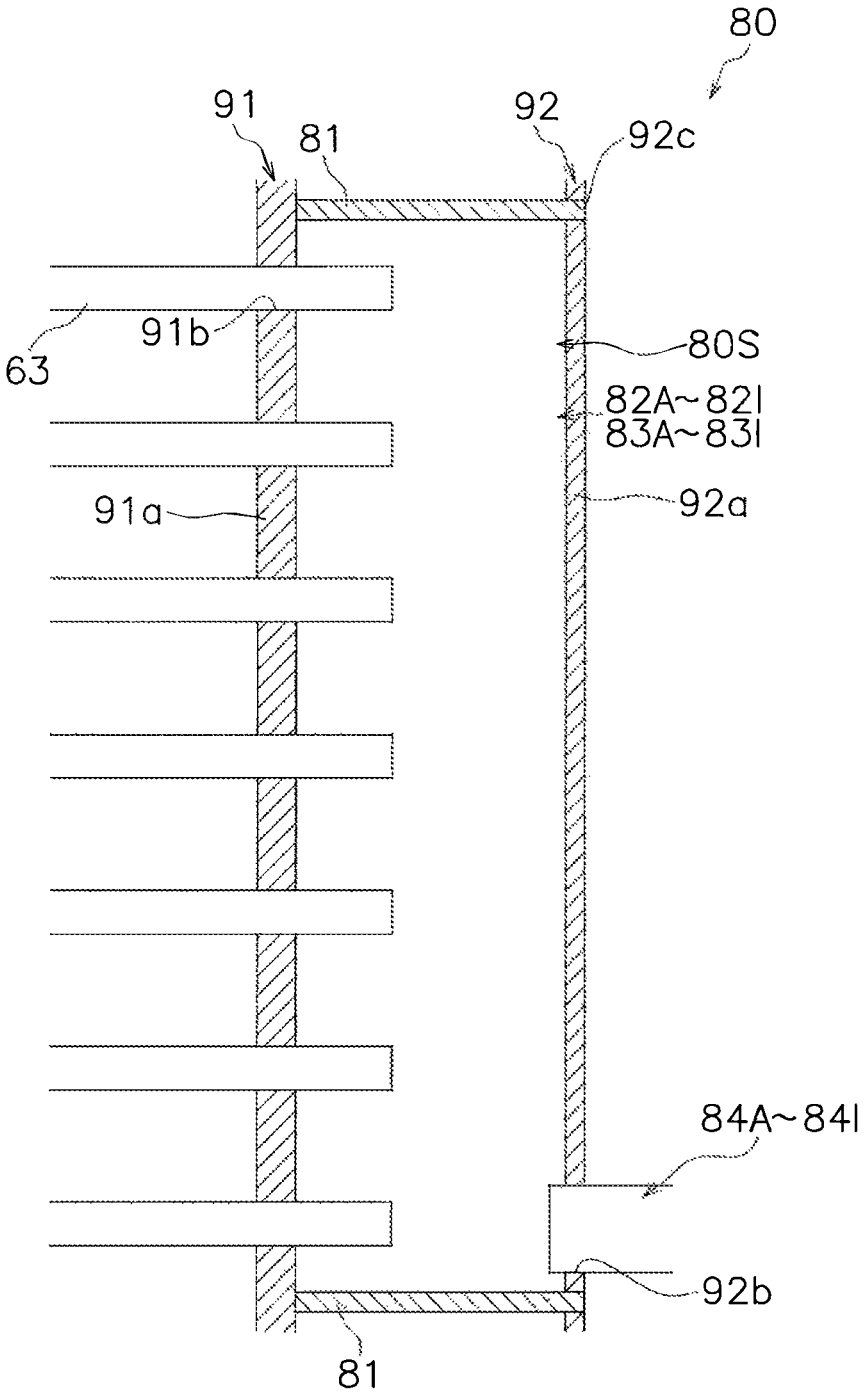
FIG. 16 is an enlarged sectional view of the vicinity of the upper and lower turn-back spaces in FIG. 15.
Figure 17:
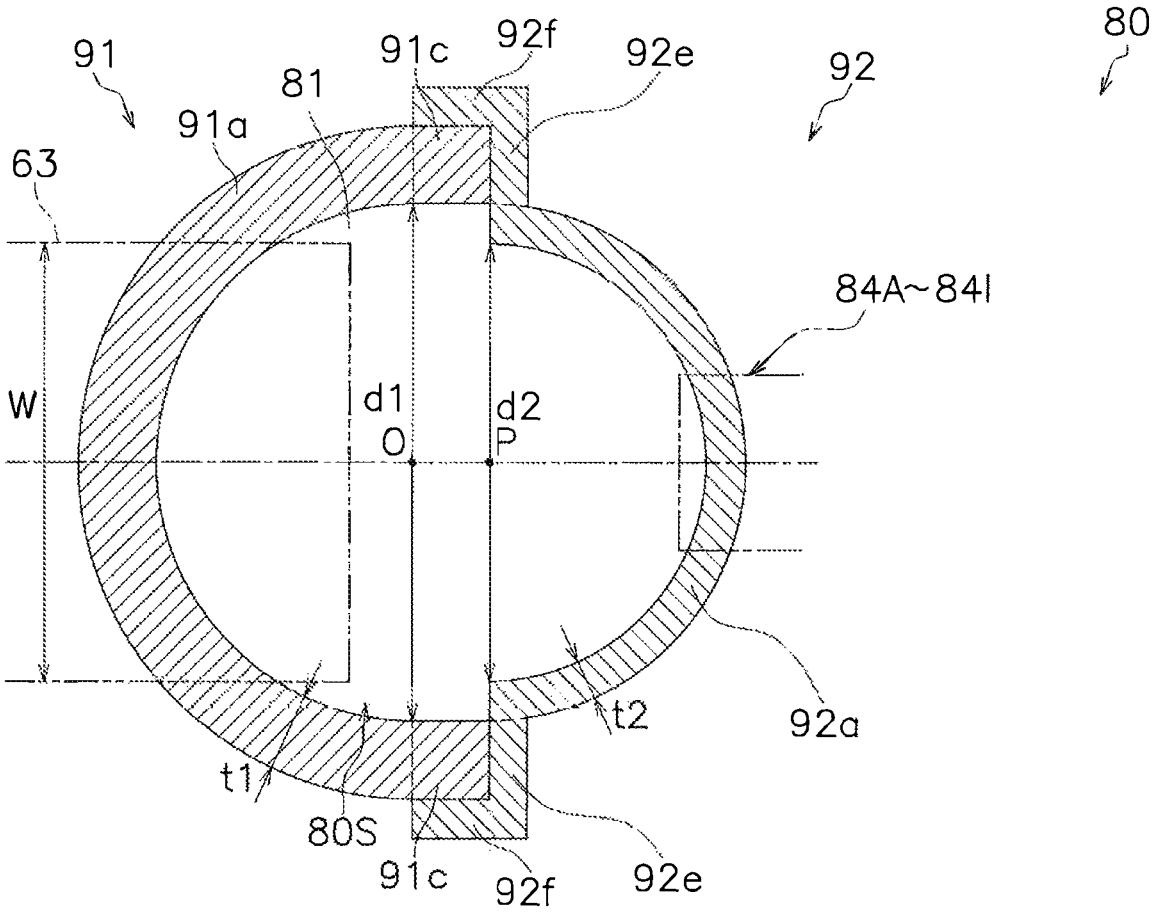
FIG. 17 illustrates an outdoor heat exchanger as a heat exchanger according to Modification C, which corresponds to a sectional view taken along line X-X of FIGS. 8 and 9 (a flat pipe and a communication pipe are shown by two-dot chain lines).

However, the structure of the header collecting pipe 80 is not limited to this. As shown in FIGS. 15 to 17, the header collecting pipe 80 may have a structure in which the intermediate-side header forming member 93 is omitted and the flat pipe-side header forming member 91 and the opposite-side header forming member 92 are directly joined.

Here, an example in which a loop structure is not provided to the upper turn-back spaces 82A to 82I of the header collecting pipe 80, as in Modification A, will be described. First, the flat pipe-side header forming member 91 and the opposite-side header forming member 92 are the same as those in the above-described Modification A (refer to the flat pipe-side header forming member 91 and the opposite-side header forming member 92 in the above embodiments and Modification A). However, this example differs from the above-described embodiments and Modification A in the following point. In the above-described embodiments and Modification A, a surface on the side of the insertion direction of the communication pipes 84A to 84I (protruding direction of the flat pipe-side curved portion 91*a*) of the opposite-side straight portion 92*e* is in contact with a surface on the side of the insertion direction of the flat pipe 63 (protruding direction of the opposite-side curved portion 92*a*) of the first intermediate-side straight portion 93*a* of the intermediate-side header forming member 93. In this example, the surface on the side of the insertion direction of the communication pipes 84A to 84I (protruding direction of the flat pipe-side curved portion 91*a*) of the opposite-side straight portion 92*e* is in contact with the end surface on the side of the insertion direction of the flat pipe 63 (protruding direction of the opposite-side curved portion 92*a*) of the flat pipe-side straight portion 91*c*. Further, here, the opposite-side header forming member 92 also includes a second opposite-side straight portion 92*f* extending straight from both ends of the opposed straight portion 92*e* in the insertion direction of the communication pipes 84A to 841, when viewed in the up-down direction (step direction). The inner surface of the second opposite-side straight portion 92*f* is in contact with the outer surface of the flat pipe-side straight portion 91*c* of the flat pipe-side header forming member 91. The contact surfaces of the flat pipe-side straight portion 91*c* of the flat pipe-side header forming member 91 and the opposite-side straight portions 92*e*, 92*f* of the opposite-side header forming member 92 are joined by brazing or the like.

Such Modification C also has the features <A> and <B> of the above embodiments.

Further, here, the opposite-side header forming member 92 further includes an opposite-side straight portion 92*e* extending straight from the end of the opposite-side curved portion 92*a* when viewed along the step direction. The opposite-side straight portion 92*e* is joined to the flat pipe-side header forming member 91.

Here, the pressure resistance of the opposite-side straight portion 92*e* joined to the flat pipe-side header forming member 91 can be increased, whereby the pressure resistance of the header collecting pipe 80 can be ensured. That is, although the opposite-side straight portion 92*e* has a lower pressure resistance than the opposite-side curved portion 92*a* having a semicircular arc shape, the substantial wall thickness of the opposite-side straight portion 92*e* can be increased by joining the opposite-side straight portion 92*e* and the intermediate-side header forming member 93. Thereby, the pressure resistance can be increased.

Further, in this example, the opposite-side straight portion 92*e* does not face the internal space 80S.

Here, the opposite-side straight portion 92*e* is not directly subjected to the internal pressure, and can contribute to securing of the pressure resistance of the header collecting pipe 80.

Here, the thickness t2 of the opposite-side header forming member 92 is smaller than the thickness t1 of the flat pipe-side header forming member 91.

Here, the material cost of the opposite-side header forming member 92 can be reduced, and as a result, the cost of the header collecting pipe 80 and, consequently, the heat exchanger 11 can be reduced. Here, the opposite-side straight portion 92*e*, which has a lower pressure resistance than that of the semicircular arc shaped opposite-side curved portion 92*a*, is joined to the flat pipe-side header forming member 91, and does not face the internal space 80S. Therefore, the thickness t2 of the entire opposite-side header forming member 92 including the opposite-side straight portion 92*e* can be reduced to the minimum necessary thickness in the opposite-side curved portion 92*a*.

<D>

While the above embodiments and Modifications A to C employ, for the turn-back header collecting pipe 80, a header structure including the flat pipe-side header forming member 91 having the flat pipe-side curved portion 91*a* and the opposite-side header forming member 92 having the opposite-side curved portion 92*a* with an inner diameter smaller than that of the flat pipe-side curved portion 91*a*, the present invention is not limited to this.

For example, the header structure (without a loop structure) of the above-described Modification A or C may be employed for the inlet/outlet header collecting pipe 70 having the internal space 70S.

Further, when the header structure (with a loop structure) of the above embodiments is employed for the inlet/outlet header collecting pipe 70, a loop structure may also be employed for the liquid-side inlet/outlet spaces 73A to 73I. That is, it is used for suppressing an uneven flow when the refrigerant sent from the liquid-side refrigerant branch pipes 77A to 77I to the liquid-side inlet/outlet spaces 73A to 73I is divided into the flat pipes 63.

<E>

In the above-described embodiments and Modifications A to D, description has been given on the example in which the outdoor heat exchanger 11 (the heat exchanger) has a path configuration in which the refrigerant turns up and down between the main heat exchange units 61A to 61I and the sub heat exchange units 62A to 62I. However, the present invention is not limited to this.

For example, the header structure of the above-described embodiments and Modifications A to C may be employed for a header collecting pipe constituting a heat exchanger having a path configuration in which the refrigerant does not turn up and down or a heat exchanger having a path configuration in which the refrigerant turns back horizontally.

<F>

In the above-described embodiments and Modifications A to E, the flat pipe-side header forming member 91 has the flat pipe-side straight portion 91*c*, but is not limited thereto. It may not have the flat pipe-side straight portion 91*c*.

Further, in the above-described embodiments and Modifications A to D, the flat pipe-side curved portion 91*a* has a semicircular arc shape divided so as to pass through the center O thereof, and the opposite-side curved portion 92*a* has a semicircular arc shape divided by a straight line passing through the center P thereof. However, the shape is not limited to this, and may be an arc shape divided by a straight line passing through a position deviated from the centers O and P. That is, the semicircular arc shape of the flat pipe-side curved portion 91*a* or the opposite-side curved portion 92*a* is not limited to an arc shape divided by a straight line passing through the centers O and P, but also an arc shape divided by a straight line passing through a position deviated from the centers O and P.

<G>

Further, in the above embodiments and Modifications A to F, the outdoor heat exchanger 11 (heat exchanger) of the outdoor unit 2 of the top-blowing type has been described as an example, but is not limited thereto. Alternatively, the heat exchanger may be of a lateral blow type outdoor unit that sucks air from the side surface of the casing and blows air from the front surface of the casing. In that case, the heat exchanger may have an L-shape in a plan view instead of a U-shape in a plan view.

The heat exchanger is not limited to an outdoor heat exchanger and may be another heat exchanger as long as it has a flat pipe and a header collecting pipe to which the flat pipe is connected. In that case, the heat exchanger may not be one in which the flat pipes 63 are arranged side by side in the up-down direction as the step direction, and the header collecting pipes 70 and 80 extend along the up-down direction as the step direction, as in the above-described embodiments and Modifications A to E. Instead, the heat exchange may be one in which the flat pipes 63 are arranged side by side in the horizontal direction or the inclined direction as the step direction, and the header collecting pipes 70 and 80 extend along the horizontal direction or the inclined direction as the step direction.

One or more embodiments of the present invention are widely applicable to a heat exchanger having a flat pipe and a header collecting pipe to which the flat pipe is connected, and an air conditioner having the same.

Although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims.

REFERENCE SIGNS LIST

1 air conditioner
11 outdoor heat exchanger (heat exchanger)
63 flat pipe
63*b* passage
70 inlet/outlet header collecting pipe (header collecting pipe)
70S internal space
80 turn-back header collecting pipe (header collecting pipe)
80S internal space
91 flat pipe-side header forming member
92 opposite-side header forming member
91*a* flat pipe-side curved portion
92*a* opposite-side curved portion
92*e* opposite-side straight portion
93 intermediate-side header forming member
93*a* intermediate-side straight portion
94 flat pipe-side space
95 opposite-side space

What is claimed is:

1. A heat exchanger comprising:

flat pipes arranged side by side in a predetermined step direction, each of the flat pipes comprising a passage for refrigerant; and a header collecting pipe connected to the flat pipes and that extends along the predetermined step direction, wherein the header collecting pipe includes:

a flat pipe-side header forming member into which the flat pipes are inserted; and an opposite-side header forming member that faces the flat pipe-side header forming member, wherein an internal space exists between the flat pipe-side header forming member and the opposite-side header forming member, when viewed along the predetermined step direction:

the flat pipe-side header forming member has a flat pipe-side curved portion protruding toward the flat pipes, and the opposite-side header forming member has:

an opposite-side curved portion protruding toward a side away from the flat pipes; and an opposite-side straight portion extending straight from an end of the opposite-side curved portion, an inner diameter of the opposite-side curved portion is smaller than an inner diameter of the flat pipe-side curved portion, a surface of the opposite-side straight portion facing toward the flat pipes is in contact with an end surface of the flat pipe-side header forming member facing away from the flat pipes, and the opposite-side straight portion does not face the internal space.

2. The heat exchanger according to claim 1, wherein the inner diameter of the opposite-side curved portion is 0.5 to 0.75 times the inner diameter of the flat pipe-side curved portion.

3. The heat exchanger according to claim 1, wherein the opposite-side header forming member is thinner than the flat pipe-side header forming member.

4. An air conditioner comprising the heat exchanger according to claim 1.

* * * * *